US008100841B2

(12) United States Patent
Rousso

(10) Patent No.: US 8,100,841 B2
(45) Date of Patent: Jan. 24, 2012

(54) PORTABLE DEVICE FOR THE ENHANCEMENT OF CIRCULATION

(76) Inventor: Benny Rousso, Rishon LeZion (IL)

( * ) Notice: Subject to any disclaimer, the term of this patent is extended or adjusted under 35 U.S.C. 154(b) by 1208 days.

(21) Appl. No.: 11/576,008

(22) PCT Filed: Sep. 26, 2005

(86) PCT No.: PCT/IL2005/001029

§ 371 (c)(1),
(2), (4) Date: Aug. 3, 2007

(87) PCT Pub. No.: WO2006/033115

PCT Pub. Date: Mar. 30, 2006

(65) Prior Publication Data

US 2008/0039752 A1 Feb. 14, 2008

Related U.S. Application Data

(63) Continuation-in-part of application No. 10/469,685, filed on Sep. 3, 2003.

(30) Foreign Application Priority Data

Sep. 26, 2004 (IL) ..... 164286

(51) Int. Cl.
*A61H 11/00* (2006.01)

(52) U.S. Cl. ..... 601/84; 601/134

(58) Field of Classification Search ..... 601/41, 601/44, 148, 149, 150, 151, 152, 84, 133, 601/134; 602/13
See application file for complete search history.

(56) References Cited

U.S. PATENT DOCUMENTS

| | | | |
|---|---|---|---|
| 718,766 | A | 1/1903 | Ingram |
| 2,118,699 | A | 5/1938 | Chappell |
| 3,804,084 | A | 4/1974 | Lehman |
| 3,853,121 | A | 12/1974 | Mizrachy et al. |
| 4,004,579 | A | 1/1977 | Dedo |
| 4,243,039 | A | 1/1981 | Aginsky |
| 4,333,181 | A | 6/1982 | Corriero |
| 4,396,010 | A | 8/1983 | Arkans |
| 4,732,140 | A | 3/1988 | Stoffregen |
| 4,770,164 | A | 9/1988 | Lach et al. |
| 4,928,674 | A | 5/1990 | Haperin et al. |
| 4,982,732 | A | 1/1991 | Morris |
| 5,009,222 | A | 4/1991 | Her |
| 5,277,697 | A | 1/1994 | France et al. |
| 5,334,131 | A | 8/1994 | Spector et al. |
| 5,399,153 | A | 3/1995 | Caprio et al. |
| 5,407,418 | A | 4/1995 | Szpur |
| 5,454,831 | A | 10/1995 | McEwen |
| 5,472,413 | A | 12/1995 | Detty |
| 5,513,658 | A | 5/1996 | Goseki |
| 5,575,761 | A | 11/1996 | Hajianpour |
| 5,738,637 | A | 4/1998 | Kelly et al. |

(Continued)

FOREIGN PATENT DOCUMENTS

| | | |
|---|---|---|
| CH | 187824 | 11/1936 |

(Continued)

*Primary Examiner* — Quang D Thanh

(57) ABSTRACT

The present invention provides a portable device and method for enhancing blood flow in a limb and for reducing the risk of peripheral vascular disorders formation by applying periodic squeezing forces on a limb, in particular a lower limb. The device comprises an actuator and at least one rigid or semi-rigid flap connected to a housing such as to form an open closure around the limb. The housing contains machinery for actuating periodical change in the position of the at least one between contracted and relaxed position.

39 Claims, 14 Drawing Sheets

U.S. PATENT DOCUMENTS

| | | | |
|---|---|---|---|
| 5,769,801 | A | 6/1998 | Tumey et al. |
| 5,865,776 | A | 2/1999 | Springs |
| 5,873,848 | A | 2/1999 | Fulkerson |
| 6,010,470 | A | 1/2000 | Albery et al. |
| 6,135,116 | A | 10/2000 | Vogel et al. |
| 6,174,295 | B1 | 1/2001 | Cantrell et al. |
| 6,231,532 | B1 | 5/2001 | Watson et al. |
| 6,290,662 | B1 | 9/2001 | Morris et al. |
| 6,478,757 | B1 | 11/2002 | Barak |
| 6,494,852 | B1 | 12/2002 | Barak et al. |
| 6,551,280 | B1 | 4/2003 | Knighton et al. |
| 6,616,620 | B2 | 9/2003 | Sherman et al. |
| 6,780,163 | B1 | 8/2004 | Krusenklaus |
| 7,004,919 | B2 | 2/2006 | Gaylord et al. |
| 7,025,738 | B2 | 4/2006 | Hall |
| 2002/0026131 | A1 | 2/2002 | Halperin |
| 2002/0169399 | A1 | 11/2002 | Rastegar et al. |
| 2002/0177793 | A1 | 11/2002 | Sherman |
| 2004/0073146 | A1 | 4/2004 | Weintraub et al. |
| 2005/0043657 | A1 | 2/2005 | Couvillon, Jr. |
| 2005/0267387 | A1 | 12/2005 | Baldauf et al. |
| 2006/0047232 | A1 | 3/2006 | Bourne et al. |
| 2006/0074362 | A1 | 4/2006 | Rousso et al. |
| 2006/0122546 | A1 | 6/2006 | Rousso |
| 2007/0055188 | A1 | 3/2007 | Avni |
| 2007/0173886 | A1 | 7/2007 | Rousso et al. |
| 2008/0015630 | A1 | 1/2008 | Rousso |
| 2008/0039752 | A1 | 2/2008 | Rousso |
| 2008/0097268 | A1 | 4/2008 | Rousso |
| 2008/0146980 | A1 | 6/2008 | Rousso et al. |
| 2008/0255494 | A1 | 10/2008 | Rousso et al. |
| 2008/0269543 | A1 | 10/2008 | Rousso |
| 2009/0118651 | A1 | 5/2009 | Rousso et al. |

FOREIGN PATENT DOCUMENTS

| | | |
|---|---|---|
| DE | 19815487 | 10/1999 |
| WO | WO97/04820 | 2/1997 |
| WO | WO00/23034 | 4/2000 |
| WO | WO00/27334 | 5/2000 |
| WO | WO01/32124 | 5/2001 |
| WO | WO01/91364 | 11/2001 |
| WO | WO02/69879 | 3/2002 |
| WO | WO 02/069879 A1 | 9/2002 |
| WO | WO2005/051250 | 6/2005 |
| WO | WO/2005/072674 | 8/2005 |
| WO | WO2005/072674 | 8/2005 |
| WO | WO2005/074376 | 8/2005 |
| WO | WO2005/120424 | 12/2005 |
| WO | WO2005/120500 | 12/2005 |
| WO | WO2005/122269 | 12/2005 |
| WO | WO2006/033114 | 3/2006 |
| WO | WO2006/033115 | 3/2006 |
| WO | WO2006/035449 | 4/2006 |
| WO | WO2006/117771 | 11/2006 |

PORTABLE DEVICE FOR THE ENHANCEMENT OF CIRCULATION

RELATED APPLICATIONS

The present invention is a continuation in part of co-pending U.S. patent application designated Ser. No. 10/469,685 titled "A PORTABLE DEVICE FOR THE ENHANCEMENT OF CIRCULATION AND FOR THE PREVENTION OF STASIS RELATED DVT" and filed 3 Sep. 2003 with priority dated 5 Mar. 2001.

The present invention is also related to Israel patent application serial number 164286 filed 26 Sep. 2004 titled A PORTABLE DEVICE FOR THE ENHANCEMENT OF CIRCULATION.

BACKGROUND OF THE INVENTION

1. Field of the Invention

The present invention generally relates to enhancement of blood and lymph flow in a limb and the prevention of peripheral vascular disorders. More specifically, the present invention relates to a portable, self contained, mechanical device for enhancing the blood in a limb, enhancing the lymph and venous return from a limb, aiming at reducing the risk of peripheral vascular disorders.

2. Discussion of the Related Art

Peripheral vascular diseases such as the development of a "blood clot" or Deep Vein Thrombosis (DVT) in a limb, specifically in the lower limbs, is a major health hazard. It may lead to local symptoms such as redness, pain and swelling of the affected limb. Peripheral vascular diseases may also pose a life hazard by sending small portions of a blood clot towards the lungs corking the circulation through the lungs (called Pulmonary Embolism), leading to reduced ability of the lungs and sometimes of the heart to function. These conditions are accompanied by pain, shortness of breath, increased heart rate and other clinical signs and symptoms.

In the ambulatory person the muscles of the leg compress the deep venous system of the leg pushing the blood towards the heart. This phenomena is called the "muscle pump". The muscles of the calf are traditionally implicated in the mechanism of the "muscle pump". During period of immobilization, stasis is believed to be a major risk factor for the formation of peripheral vascular disorders. Immobilization includes any period of lack of physical activity whether in the supine or sitting position e.g. bed or chair ridden persons, during long automobile trips, long flights, long working hours in the sitting position, etc.

Increasing the flow of blood in the limb during periods of immobility is designed to prevent the occurrence of peripheral vascular disorders and to alleviate symptoms for patients of such disorders.

Prevention of peripheral vascular diseases and especially those related to stasis is commonly achieved via large and cumbersome devices or treatment. Most of these devices can be used by trained medical staff only. Such devices operate by either of two methods: Pneumatic/Hydraulic intermittent compressions or by direct intermittent electrical stimulation of the "muscle pump". The Pneumatic/hydraulic devices use a sleeve or cuff with a bladder that is inflated and deflated by air or fluid compressor thus causing stimulation of the physiological "muscle pump". The pneumatic/hydraulic devices usually require a sophisticated set of tubes and valves, a compressor, a source of fluid and a sophisticated computer control. Moreover such devices emit substantial noise while operating. The electrical stimulators work by delivering electrical impulses to the calf muscles. These devices require a sophisticated electronic apparatus and may be painful or irritating to patient.

Most existing devices aimed at preventing peripheral vascular disorders are designed for use in the medical setting, by trained personal. Such devices are generally non-portable. Most of the devices known in the art operate using a flap that is flexible and circle the circumference of the limb treated. The devices are in most cases cumbersome and a patient requires the assistance of a helper in order to put these devices on his extremities.

Accordingly it is the object of the present invention to provide a device for the enhancement of blood and lymph flow in a limb and the prevention of peripheral vascular disorders which simulate intermittent muscle compression of a limb and is portable, self-contained. The device is easily carried, small, and lightweight, is simple to operate by a lay person without special training in the field of medicine, is easily attached over or to a limb and can be easily be adjusted to fit persons of any size.

SUMMARY OF THE PRESENT INVENTION

In accordance with the above objects, the present invention provides a portable device and method for enhancing blood or lymph flow in a limb and for reducing the risk of various ailments associated with [peripheral vascular disease by applying periodic squeezing forces on a limb, in particular a lower limb.

In accordance with one aspect of the present invention there is provided a portable device for modulating blood or lymph flow in a limb, the device comprising an actuator to provide intermittent power associated with one or more flaps partially encircling said limb so as enable a hold of said limb. Said actuator provides controlled periodical change through the movement of the position of said flaps relative to the position of the limb thereby applying intermittent squeezing forces on the limb and modulating blood or lymph flow within said limb. The flap can be rigid or semi-rigid, have one or more segments, semi circular shape, arch rounded or angled shape, or the like. The segments can be positioned so as to form an angle with an at least one other segment of the at least one flap. The segments are preferably substantially parallel to each other and move inwardly such as to apply compression force to said limb. In the device the one or more flaps are coupled to the actuator and the periodical change of the flaps is actuated by intermittently pulling and releasing the flaps relative to the actuator. The flaps can be coupled to the actuator and the periodical movement is preferably actuated by a motor and machinery compressing and releasing a compressing element. The compressing element can be a moveable plate, one or more straps, one or more flaps, an inflatable bladder, an inflatable cell, or a combination thereof. The machinery can comprise a pneumatic mechanism. The motor can be an electrical motor having a spinning worm shaft. The machinery can comprise a hydraulic mechanism, an aerosol or compressed liquid container. The device is preferably placed against the tissues or the bone of said limb. The device also comprises regulator for regulating the frequency of the periodical change. The periodical change comprises one or more contracted or relaxed states, or a non-fixed in length one or more states, whether relaxed or contracted. The device can also comprise a regulator for regulating the length interval between contracted and relaxed states.

The periodical change can comprise one of the following: fast transition from relaxed to contracted state; fast transition from contracted to relaxed state; slow transition from relaxed to contracted state; slow transition from contracted to relaxed state; fast transition from contracted to relaxed state; a short duration of a contracted state and a longer duration of relaxed state; a long duration of a contracted state and a shorter duration of relaxed state; a fast compression stage followed by a slow relaxation stage; or a slow compression stage followed by a fast relaxation stage.

The machinery can comprise a speed reducing wheel coupled to a shaft and a crankshaft coupled to said wheel and connected to the end of the flaps by means of a laterally movable connector for intermittently pulling and releasing the flaps in and out. The motor can be a pull-push electromagnetic motor having a reciprocating rod. The machinery comprises a tooth-wheel coupled to said reciprocating rod by means of a spike-tooth projected from said reciprocating rod and a crankshaft coupled to said wheel and connected to the end of the one or more flaps by a laterally movable connector for intermittently pulling or releasing said one or more flap. The mechanism further comprises an energy chargeable element disposed between the motor and one or more flaps, and one or more energy applying mechanism coupling between said energy chargeable element and said flaps, said energy applying mechanism enables fast release of energy stored in said chargeable element and the use of the energy so released to effectuate at least one abrupt transition. The abrupt transitions is between a relaxed and strained states or between a strained and relaxed states at a length of about less than 10 seconds, or about less than 1 second, or about less than 300 milliseconds, or about less than 30 milliseconds. The abrupt transition is the transition from a contracted to a relaxed state or the transition from a relaxed to a contracted state. The device can further include a frequency regulator and a housing encasing the actuator or the other elements of the invention, such as the motor and machinery and be mounted on the limb. The actuator can be a motor, or a pneumatic pump, connected to a power transferring element. The actuator can be located remotely to the portable device and is associated therewith by a power transferring element. The power transferring element is a pipe or a rotating screw.

The device is designed to alleviate symptoms of peripheral vascular disorder. The device can be used treating any one of the following: a vascular disorder; a deep vein thrombosis; lymphedema, chronic wounds, venous insufficiency, peripheral arterial disease. The device can also be used to improve circulation of blood or lymph flow.

In accordance with a second aspect of the present invention there is provided a a portable device for modulating blood or lymph flow in a limb, the device comprising a power generating element to provide power to actuate one or more flaps or straps; a conduit for transferring said power to a compressing element; a compressing element for providing compressing forces to the limb; wherein said compressing element is located remotely from said power generating element. The compressing element comprises an energy transforming element to transform said power to movement force and one or more straps or flaps for providing intermittent compressing forces to the limb, thereby modulating blood or lymph flow in said limb. The power generating element comprises an actuator. The power generating element provides controlled periodical change through the movement of the position of the compressing element relative to the position of the limb. The compression is applied intermittently or continuously to the limb. The actuator is a pneumatic pump generating compressed fluid to be delivered via said conduit to said compressing element. The actuator is a motor and associated machinery generating transferable energy to be delivered via said conduit to said compressing element.

The device also comprises a housing, said motor, machinery and actuator are housed therein, and said housing is applied to the limb. The actuator further comprises energy storage to provide power to said actuator. The energy storage can be a battery. The conduit is a rigid or a semi-rigid or a flexible line to transfer the power generated by the power generating element to the compressing element. The conduit can be a plastic pipe transferring compressed air generated by a pneumatic pump. Alternatively, the conduit is a pipe housing a revolving flexible element transferring energy from the power generating element to the compressing element.

The compressing element comprises an energy transforming mechanism to receive power from the power generating element and translate said energy to movement of the one or more flaps or straps in a direction such that the one or more flaps or straps apply squeezing forces on the limb. The energy transforming mechanism comprises one of the following: a spring, an inflatable bladder, a mechanism comprising cogwheel and rods, wherein the mechanism receives energy transferred via conduit and transforms the energy into movement force. The bladder is inflated or deflated periodically through fluid transferred via conduit.

The device also comprises two or more levers invertly connected through at least one pivot to said one or more flaps or straps applying compression on said limb. The device further comprises at least one release valve for releasing fluid from said bladder, one return spring for forcing the two levers to move inwardly. The return spring is preferably juxtaposed between bottom sides of the two levers and above the pivot to avoid contact with the limb of the user.

In accordance with a third aspect of the present invention there is provided a method for modulating blood or lymph flow in a limb, the method comprising the steps of generating intermittent power via an actuator associated with at least one flap partially encircling said limb so as enable a hold of said limb; and providing controlled periodical change through the movement of the position of said at least one flap relative to the position of the limb; thereby applying intermittent squeezing forces on the limb and modulating blood or lymph flow within said limb. The method further comprising the step of intermittently pulling and releasing said at least one flap relative to said actuator. The periodical movement is actuated by a motor and machinery compressing and releasing a compressing element. The method further comprises the step of placing the at least one flap against the tissues or against the bone of said limb. The method further comprises the step of regulating the frequency of said periodical change. The periodical change can comprise one or more contracted states with one or more relaxed states, or having a non-fixed in length one or more states. The step of regulating is performed by a regulator for regulating the length interval between contracted and relaxed states. The method can be used for treating or alleviating any one of the following: a vascular disorder; a deep vein thrombosis; lymphedema, chronic wounds, venous insufficiency, peripheral arterial disease. The method can also be used to improve circulation of blood or lymph flow.

In accordance with a fourth aspect of the present invention there is provided a method for modulating blood or lymph flow in a limb, the method comprising the steps of generating power through a power generating element to provide power to actuate one or more flaps or straps; transferring said power through a conduit to a compressing element; providing compressing power to the limb through a compressing element; wherein said compressing provides intermittent compression to the limb. The method further comprising the step of transforming said power to movement force, through a power transforming element, applied to the one or more straps or flaps for providing intermittent compressing forces to the limb, thereby modulating blood or lymph flow in said limb. The step of providing power comprises the step of providing controlled periodical change through the movement of the position of the compressing element relative to the position of the limb. The compression is applied intermittently or continuously to the limb. The actuator is a motor and associated machinery generating transferable energy to be delivered via said conduit to said compressing element. The method further comprising the step of providing energy to said actuator from an energy storage, such as a battery. The method further comprising the step of inflating or deflating said bladder periodically through fluid transferred via a conduit and regulating the frequency of said periodical change via a regulator.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

A device for the intermittent compression of the extremities tissues for the enhancement of blood and lymph flow in a limb and the prevention of peripheral vascular disorders is disclosed. The device comprises a housing encasing machinery coupled to a motor and one or more flaps associated with the housing for partially encircling the limb of the user so as to form a partially open hold of the limb. During operation, the machinery actuates periodical intermittent squeezing forces on the limb through the flaps.

Figure 1:
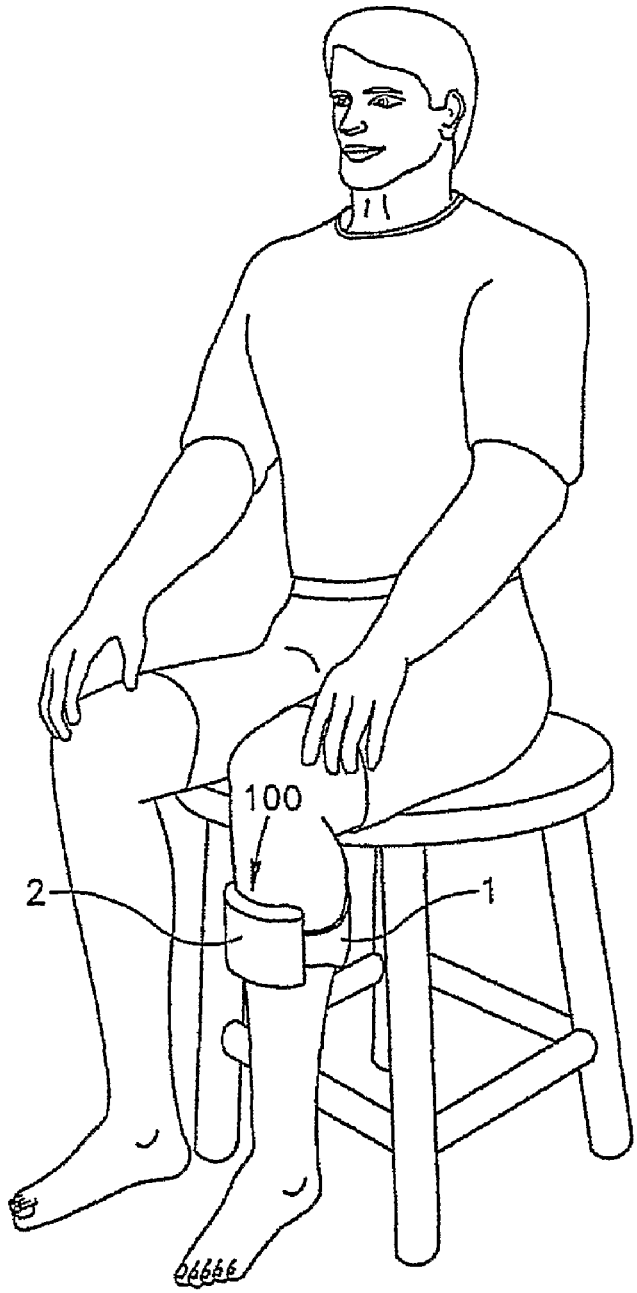
FIG. 1 is a pictorial illustration of the device of the present invention flapped to the calf of a sitting person.

The portable device of the present invention, generally designated 100, is shown in FIG. 1, worn on the calf of a sitting person. Device 100 can be worn directly on the bare limb, or on a garment, such as trousers, worn by the person using the device.

Device 100 comprises two main components, an assembly box 2 which contains all the machinery parts responsible for the device operation, and a flap 1 connected to said assembly box such as to form a closed loop (designated 50, see FIG. 2) for encircling a person limb. The power supply for the device may be of the internal power supply type such as a rechargeable or non rechargeable low voltage DC batteries or an external power supply type such as an external power outlet connected via an AC/DC transformer such as a 3-12V 1 Amp transformer, fed through electrical wires to a receptacle socket in the device (not shown).

As shown in FIG. 1, flap 1 is preferably wide in the middle and narrow at the ends where it connects to assembly box 2. Flap 1 however may assume any other shape and form such as a constant width belt. The flap can be fabricated from any flexible material that is non-irritating to the skin, such as thin plastic, woven fabric and the like. Flap 1 can be fabricated from one material or alternatively can combine more than one material. For example, flap 1 can be made of both non stretchable material and stretchable material wherein such an arrangement may be dispose of a stretchable material for example rubber fabric in the center of the flap 1 and a non stretchable material such as plastic flanking the stretchable material and comprising the rest of the flap. Such an arrangement facilitates a more uniform stretch force on the flap as well as preventing the slippage of the flap from the limb.

According to the preferred embodiment shown in FIG. 1, hereinafter called the anterior box embodiment, flap 1 is placed against the tissues while assembly box 2 is placed against the calf bone. However, according to another embodiment of the present invention, hereinafter called the posterior box embodiment, assembly box 2 can be placed against the tissues.

Figure 2A:
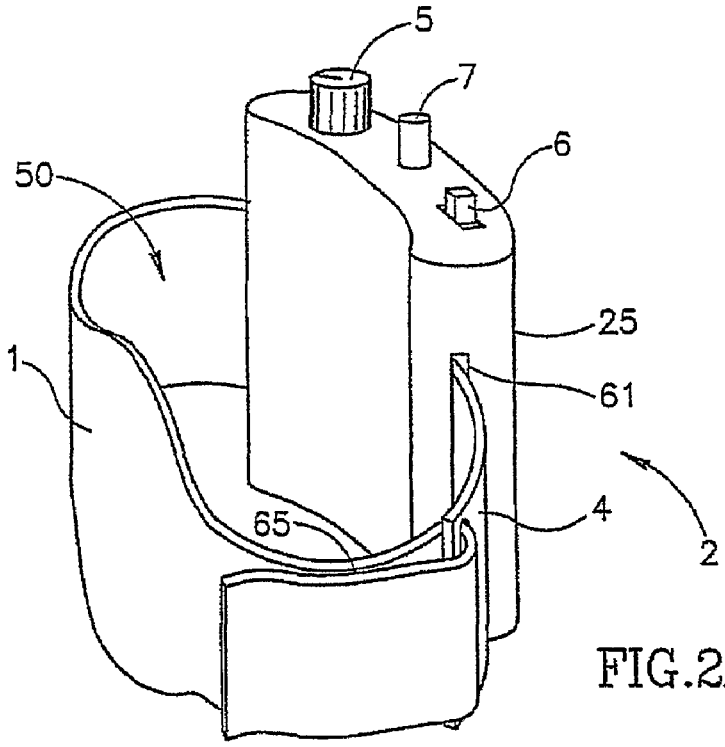
FIG. 2A is a side external view of a preferred anterior box embodiment of the present device, in which squeezing the limb muscles is performed by intermittent shortening the circumference of a loop created by an assembly body and flap.

FIG. 2 illustrate two possible embodiments of the device of the present invention. FIG. 2A represents a preferred embodiment of the present device, in which squeezing the limb tissues for promoting the increase of blood and lymph flow in the limb, is performed by pulling and releasing flap 1, thus, intermittently shortening the effective length of loop 50 encircling the limb. This embodiment is preferably used as an anterior box embodiment of the present invention. However, it will be easily appreciated that the device of FIG. 2A can be used as a posterior box embodiment as well.

Figure 2B:
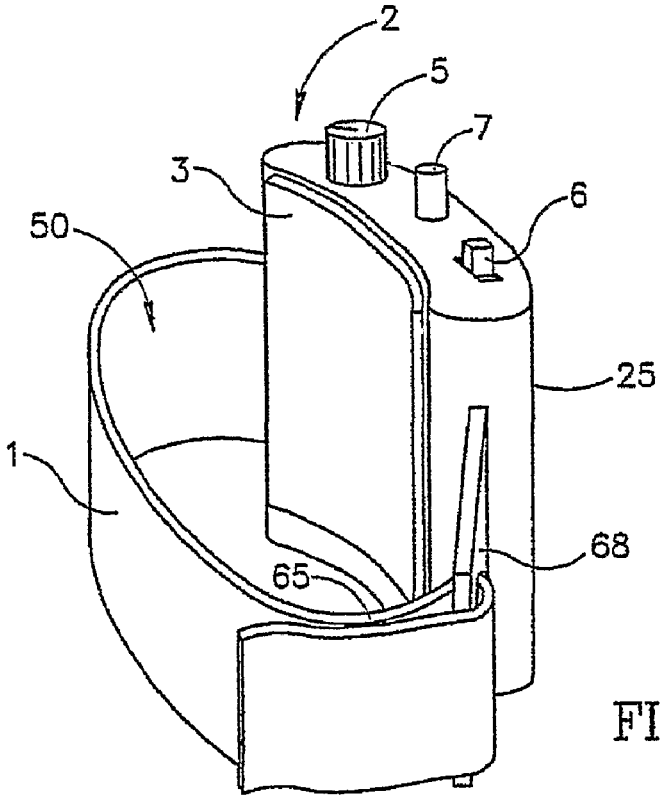
FIG. 2B is a side view illustration of an posterior box embodiment in which the assembly box is the active intermittent compressing part placed against the calf muscles.

FIG. 2B presents another embodiment of the present device in which assembly box 2 is the active intermittent compressing part by means of mobile plate 3 attached to the box. This embodiment, which can be used only as a posterior box embodiment, will be explained in conjunction with FIG. 6.

Turning back to FIG. 2A, assembly box 2 comprises a thin, curved flask-shaped casing 25 which contains all the parts of internal machinery responsible for intermittent pulling and releasing flap 1. Casing 25 is preferably fabricated from, but not limited to, a plastic molding, a light metal, or any other material which is light, non irritating to the skin, and cheep to produce.

Flap 1 is connected at both its ends to assembly box 2 by means of two buckles 4 and 42 at the sides of casing 25 (buckle 42 not shown). At least one of said buckles (here buckle 4) is a mobile buckle, which can move in and out of casing 25 through slit (opening) 61, thus pulling and relaxing flap 1 between a retracted and a relaxed positions. The retraction protraction motion shortens and lengthens the effective length of flap 1, thus causing intermittent compression of the underlying tissue and increasing the blood and lymph flow in the underlying vessels. Possible inner machinery responsible for activating the intermittent pulling of flap 1 is described in the following in conjunction with FIGS. 3 to 6.

Flap 1 can be adjusted to fit the size of the limb, on which device 100 is to be operated, by having at least one of its ends free to move through its corresponding buckle, such that the flap can be pulled by said end for tightening the flap around said limb. Said end is then anchored in the appropriate position.

In the example shown here, the flap is folded back on itself and the overlapping areas are fastened to each other by fastening means 65, such as Velcro™ strips, snap fasteners or any other fastening or securing means. Alternatively, said flap end can be secured to casing 25 by fastening means such as Velcro strips, opposite teeth-like protrusions both on casing 25 and on flap 1, and the like.

The second end of flap 1 can be connected to its corresponding buckle either in a permanent manner by attaching means such as knots or bolts, or can be adjustable in a similar manner to what had been described above, allowing both ends to be pulled and anchored simultaneously for better fitting.

Yet, in accordance with another embodiment of the invention, the flap can be wound around a retracting mechanism positioned at one side of casing 25. The free end of the flap can be provided with a buckle for allowing connection into the opposite side of casing 25 either by one of the aforementioned means described or by means of a quick connector.

Outer casing box 25 also includes an on/off switch 6, a force regulator 5 for regulating the force exerted on the calf tissue by flap 1 and a rate regulator 7 for regulating the frequency of intermittent compressions. Alternatively, force regulator 5 and on/off switch 6 can be combined into one button. Force regulation can be obtained for example by way of controlling the length of the flap interval between retracted and protracted positions. The length interval between contracted and relaxed positions is preferably, but not limited to, 1-50 millimeters. Frequency regulation can be obtained by way of regulating, but not limited to, the speed of the inner machinery.

A person skilled in the art will readily appreciate that the present invention can be used for the enhancement of both arterial and venous blood and lymph flow in a limb (upper and lower). The examples provided in the following discussion serve as an example and should not be construed as a limitation to the application of the preset invention.

Figure 3A:
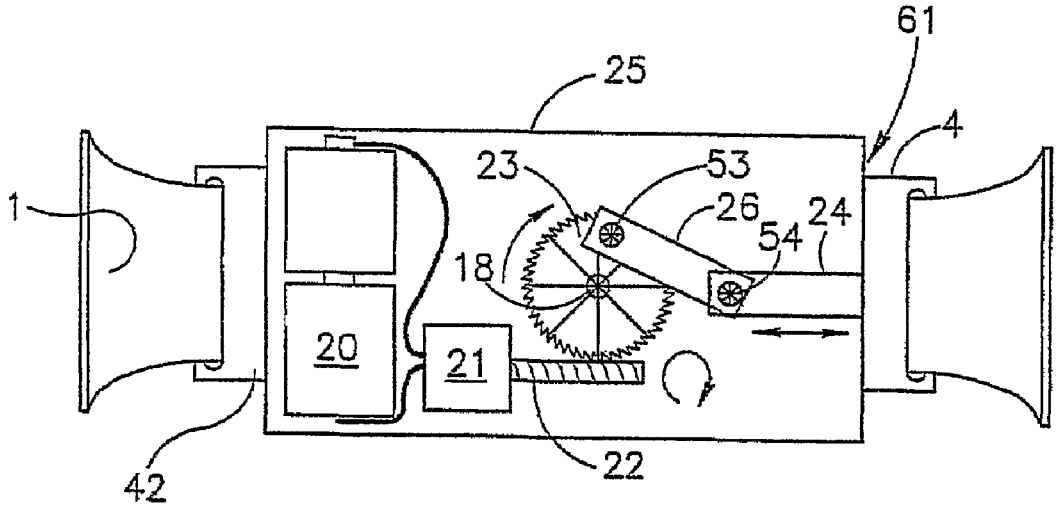
FIG. 3A is a cross section of a device in accordance with the embodiment of FIG. 2A, showing a first internal mechanism of the assembly box.
Figure 3B:
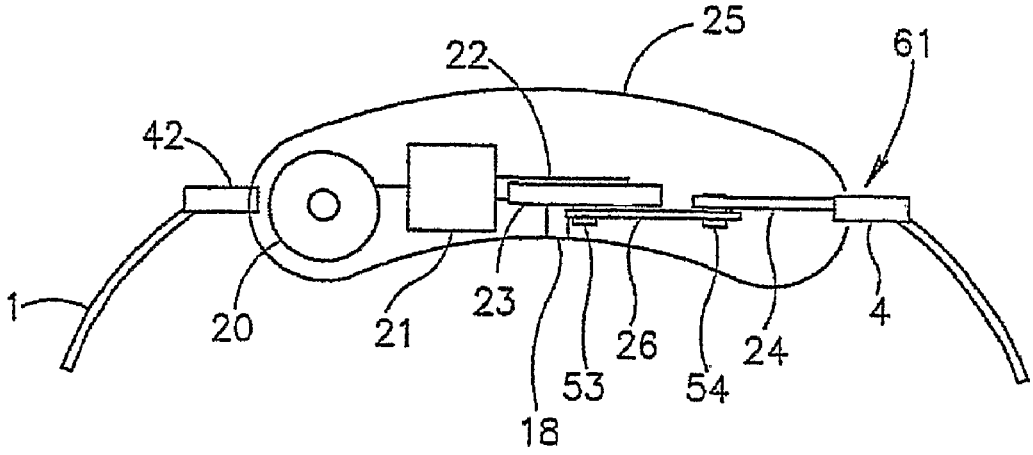
FIG. 3B is a top view of the device of FIG. 3A.

Referring now to FIGS. 3A and 3B, there is shown a side view and a top view respectively of first inner machinery for the device of FIG. 2A. The numerical are corresponding in both drawings. According to this embodiment, one end of flap 1 is connected to assembly box 2 via a fixed fitting 42 by means such as bolts, knots glue, etc. The second end is connected via a movable buckle 4, which traverses slit 61 located at the side of casing 25. Buckle 4 can retract and protract through opening 61, as described above. Movable buckle 4 is connected to the inner machinery by means of attachment to a rigid push/pull rod 24

The inner machinery responsible for the motion of movable buckle 4 is herein described. Energy source 20 such as low voltage DC batteries, supplies electrical energy to an electrical motor 21 such as, but not limited to, a 3-12 V DC motor, via electrical contacts such as wires.

Electric motor 21 converts electric energy into kinetic energy, spinning a spirally grooved (worm) central shaft 22. Shaft 22 is coupled to a (speed reduction) wheel 23, having complementary anti-spiral circumferential grooves or teeth, causing wheel 23 to revolve around its center which is fixed by axis 18 perpendicular to its surface. An elongated connector plate 26 is pivotally jointed at one end to off-center point 53 on wheel 23 and at its second end to rod 24 at point 54, such that the rotation of wheel 23 actuates plate 26 to intermittently push and pull rod 24, in a crankshaft manner. Consequently, mobile buckle 4 is intermittently pulled inward and outward casing 25 through slit 61, thus intermittently shortening the circumference of loop 50.

Figure 3C:
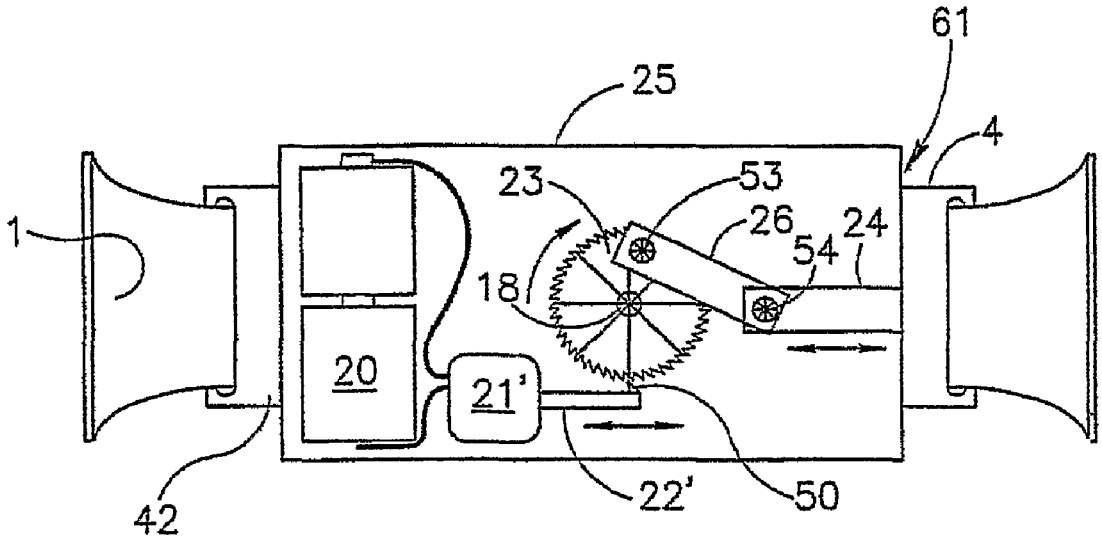
FIG. 3C depicts a modified mechanism of the embodiment of FIGS. 3A and 3B.

Modified machinery, represented in FIG. 3C, includes the following changes with reference to FIG. 3A and 3B. The electric motor 21 and spinning worm shaft 22 are replaced with an electromagnetic motor 21' (such as a push-pull solenoid 191C distributed by Shindengen electric Ltd.) having a reciprocating central rod 22' with an upwardly inclined spike-tooth projection 50 at its end. Rod 22', via projection 50 is coupled to wheel 23, having complementary teeth. As reciprocating rod 22' slightly protrudes from, and retracts into the motor body, projection 50 latches sequential teeth of wheel 23 as it protrudes and pulls wheel 23 as it retracts, causing wheel 23 to revolve around its axis. The mechanism of FIG. 3C generates a large force output while minimizing the power input. Such machinery is cost effective.

The above description clearly shows how the internal mechanical machinery of the proposed device acts to intermittently shorten loop 50, culminating in intermittent compression of the leg or hand tissue and leading to increase of venous return and helping in the prevention of the formation of deep vein thrombosis.

Figure 4A:
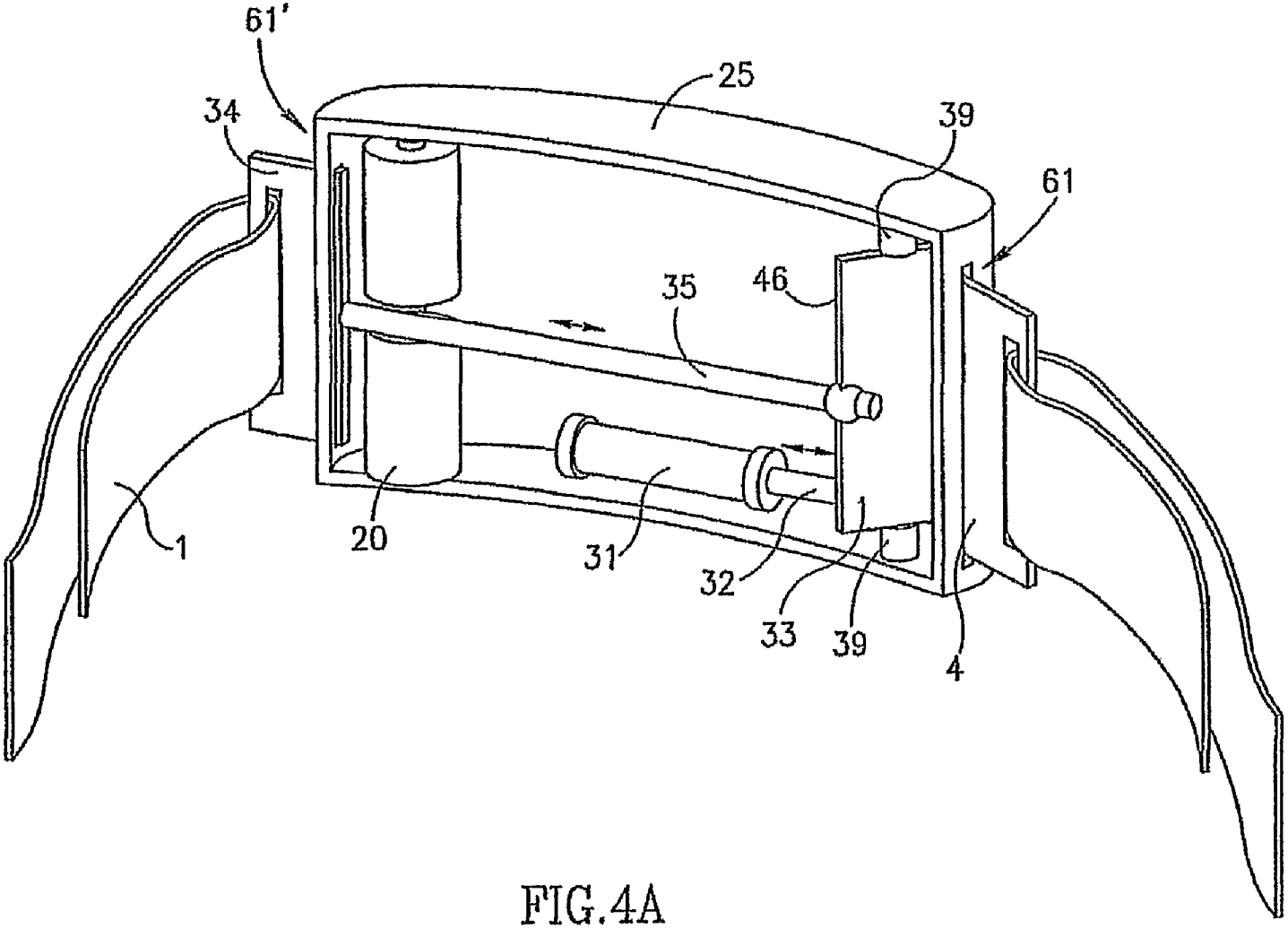
FIG. 4A is pictorial representation of an alternative mechanism for the embodiment of FIG. 2A using electromagnetic motor, a centrally hinged rotating rectangular plate and a longitudinal bar connecting both sides of the flap.
Figure 4B:
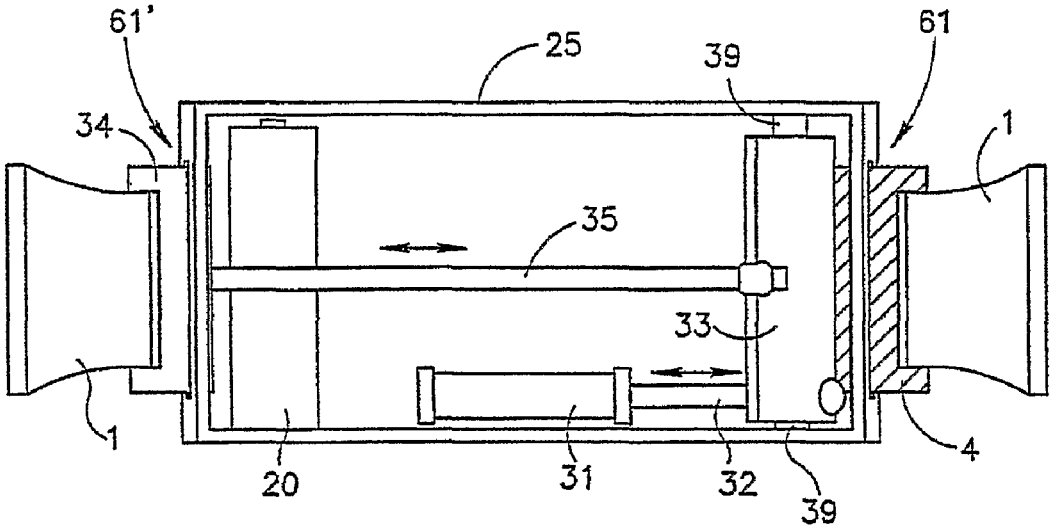
FIGS. 4B and 4C are side and top view respectively of the embodiment presented in FIG. 4A.
Figure 4C:
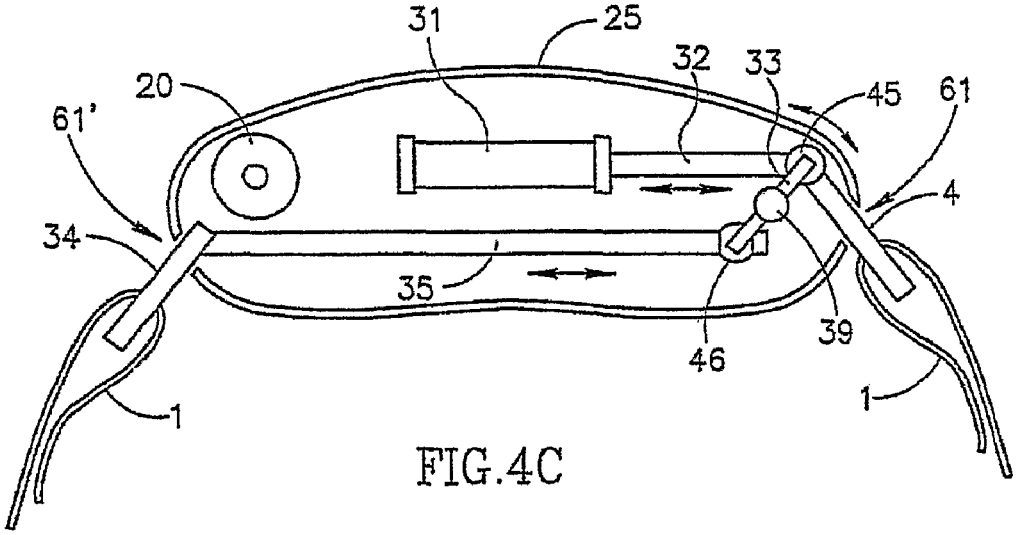

An alternative machinery embodiment for the device embodiment of FIG. 2A is shown in FIGS. 4A, 4B and 4C. FIG. 4A is a perspective drawing view showing the internal parts of assembly box 2 with the frontal part of casing 25 removed. FIG. 4B and 4C side and top view, respectively of the embodiment shown in FIG. 4A. According to this embodiment, both ends of flap 1 are connected to the inner machinery of assembly box 2 by means of two movable buckles 4 and 34, which can move inwardly, and outwardly casing 25 through slits 61 and 61', respectively.

This alternative embodiment combines the following elements:

A rectangular plate 33 positioned close to one side wall of casing 25, adjacent to slit 61. Plate 33 having two parallel rectangular surfaces, two narrow vertical edges, designated 45 and 46, and two narrow horizontal edges. Plate 33 is pivotally mounted at its narrow horizontal edges to the top and bottom walls of casing 25, by pivoting means 39, such as to allow rotational movement of the plate around the vertical axis connecting between pivoting means 39;

A push-pull electromagnetic motor 31 (such as pull tubular solenoid 190 distributed by Shindengen electric Ltd.) connected via its reciprocating central rod 32 to one vertical edge (45) of the centrally hinged rectangular plate 33, at about mid point of said edge;

A longitudinal rod 35 spans the length of casing 25. Said longitudinal rod 35 is connected at one end to the opposite vertical edge (46) of plate 33 and at its second end to movable buckle 34 positioned at the other side of casing 25.

Centrally hinged rectangular plate 33 is thus connected on one side to the electromagnetic motor 31 via central rod 32, and on the other side to longitudinal rod 35 (as best seen in FIG. 4C). Movable buckle 4 is also connected to narrow edge 45 of plate 33 but extends outwardly, through slit 61, in the opposite direction to rods 32 and 35.

As can be best seen in FIG. 4C, the reciprocating movement of rod 32 causes plate 33 to turn back and forth around its central axis, preferably the angular displacement is in the range of 20 to 60 degrees. Consequently, buckles 4 (coupled directly to plate 33) and 34 (by means of connecting rod 35) are synchronously pulled and pushed inward and outward of casing 25, resulting in intermittent shortening of the limb encircling loop. This embodiment is advantageous because the longitudinal rod 35 allows both buckles 34 and 4 to approximate each other at the same time, thus enhancing the efficiency of the device (by enhancing the reciprocating displacement of electromagnetic motor 31) and requiring less energy.

Figure 5A:
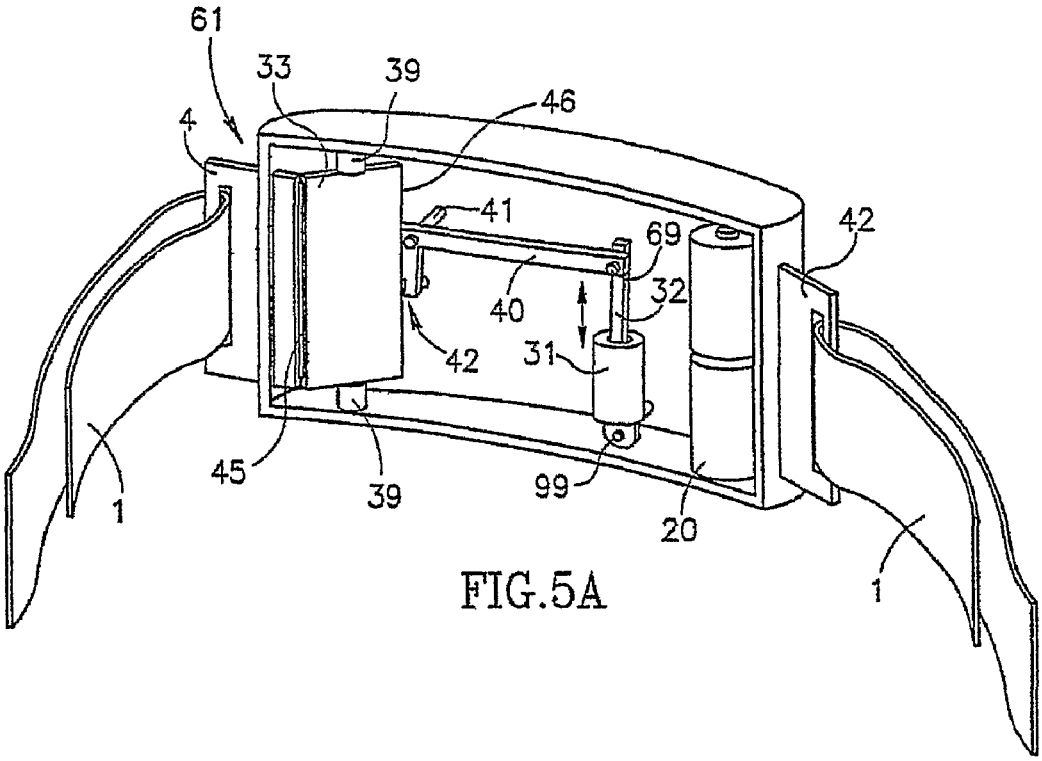
FIGS. 5A and 5B depict yet another mechanism for the embodiment of FIG. 2A using an enhanced power transmission by means of an "L" shaped lever bar.
Figure 5B:
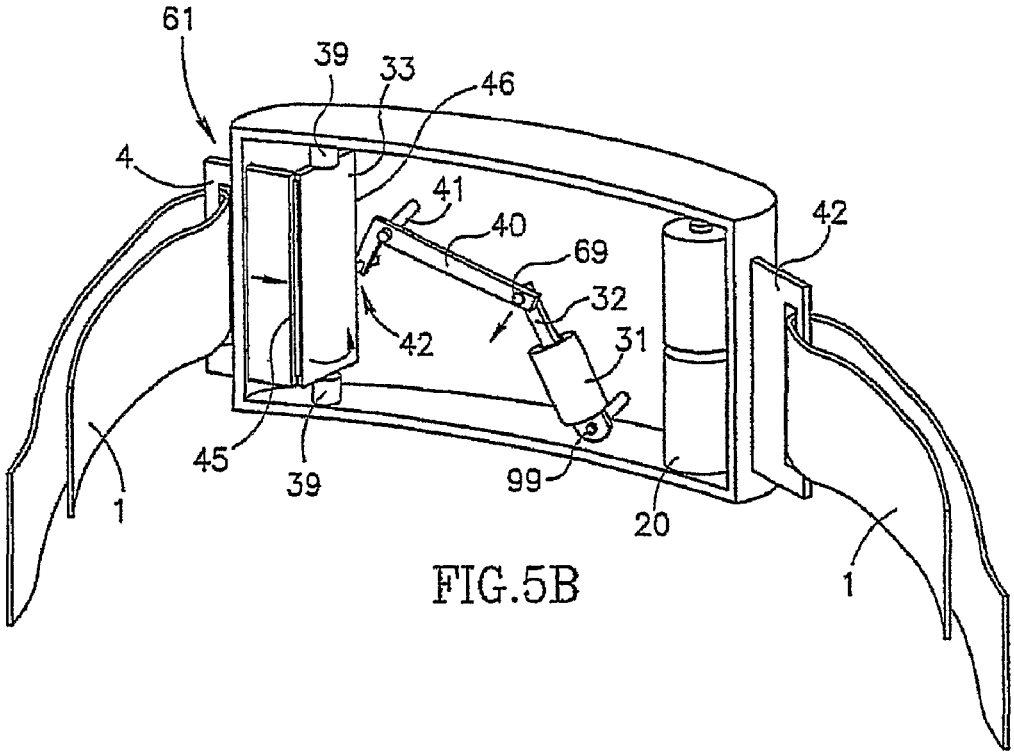

FIGS. 5A and 5B illustrate yet another alternative machinery for the device embodiment of FIG. 2A. The embodiment of FIG. 5 also uses a pull-push electromagnetic motor as the driving force but allows force enhancement by the addition of an "L" shaped lever bar 40 to the said centrally displaced rod 32 of the embodiment shown in FIG. 4. According to this embodiment, one edge of flap 1 is connected to fixed buckle 42 while the second end is connected to movable buckle 4 which transverse casing 25 through side slit 61. The movable buckle 4 is connected to centrally hinged rectangular plate 33 in a similar manner to what have been described in conjunction with FIG. 4.

In accordance with the present embodiment, electromagnetic motor 32 is pivotally mounted at its rear end to the base by pivoting means 99. The "L" shaped lever bar 40 pivotally mounted at its longer arm end to reciprocating rod 32 by pivoting means 39, and at its shorter arm end is attached to narrow edge 46 of plate 33, by attaching means 42, in a manner which allows it to slide up and down said edge. Such attaching means can be obtained, for example, by railing means such as a groove engraved along the edge of the short arm of lever 40 and a matching protruding railing extending from narrow edge 46 of plate 33. The right-angled corner of "L" shaped bar 40 is pivotally anchored to casing 25 by means of axis 41 perpendicular to the bar surface.

FIG. 5A represents the "relaxed" mode (i.e., buckle 4 in protracted position), while FIG. 5B is in a "contracted" mode (buckle 4 in retracted position). To understand the action of this embodiment a static description of the "relaxed" mode followed by the "contracted" mode description is herein given. The "relaxed" mode in FIG. 5A, illustrates the electromagnetic motor 32 at a perpendicular position to the base of casing 25, and "L" shaped lever 41 in a perpendicularly positioned to reciprocating rod 32. The "contracted" mode is shown in FIG. 5B. When reciprocating rod 32 retracts into electromagnetic motor 31, it causes the "L" shaped to rotate around axis 41, such that connection 69 moves toward electromagnetic motor 31 as well as toward the rectangular plate 33. This rotation is allowed due to pivot attachment 99 of electromagnetic motor 31 and pivot attachment 41 of "L" shaped lever bar 40. The other end of the "L" shaped lever bar 41 slides in the upward direction on edge 46 of rectangular plate 33 and at the same time it pushes plate 33 causing it to rotate counterclockwise such that edge 45 and consequently buckle 4 are drawn deeper into casing 25.

When reciprocating rod 32 reciprocates its motion, "L" shaped bar 41 returns to its "relaxed" perpendicular position (FIG. 5A) and consequently edge 45, along with buckle 4 are pushed outwardly. Thus, this chain of events leads to an effective intermittent shortening of the limb encircling loop (50) and to an intermittent compression of the underlying tissue enhancing the blood flow.

Figure 6:
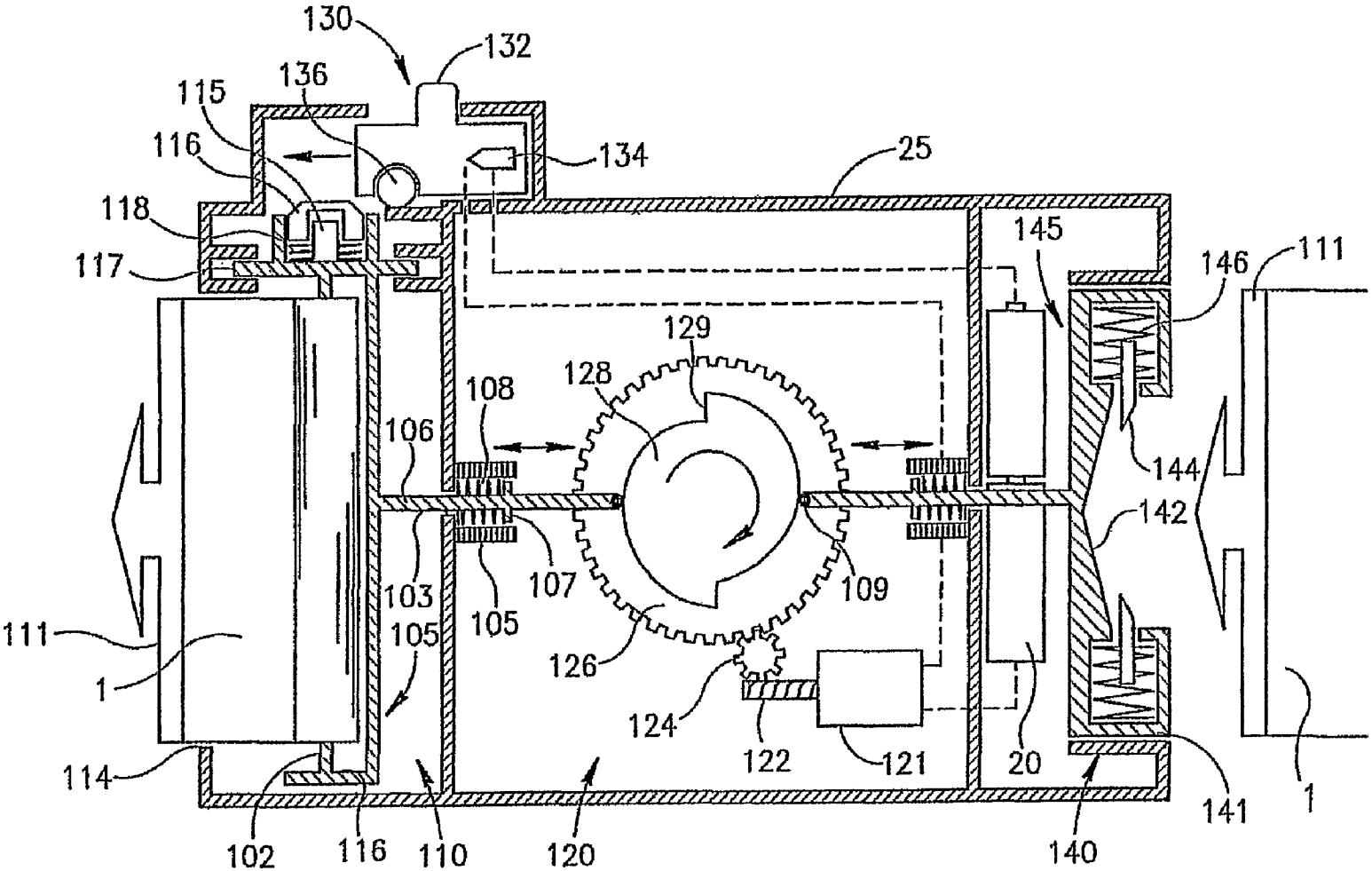
FIG. 6 is a side view of yet another embodiment of a device in accordance with the present invention.

FIG. 6 illustrates yet another preferred embodiment of the present invention, including means for allowing asymmetrical contraction-relaxation cycle and in particular for allowing fast contractions, followed by much longer periods of relaxation. Such a cyclic pattern is found to have the most beneficial effect for enhancing blood and lymph flow. In accordance with this embodiment, the machinery components responsible for intermittent pulling and releasing flap 1 comprises a motor 121 having a worm shaft 122, a speed reducing gear comprising wheels 124 and 126, coupled to shaft 122, and a disk 128 of irregular perimeter, concentrically mounted on wheel 126. Double-tooth disk 128 is shaped as two identical halves of varying curvature radius, each having a gradual slope at one end and a cusp 129 where the radius changes abruptly from maximum to minimum at its second end, wherein between two ends the radius of curvature is almost constant. The machinery components, including motor and wheels, are accommodated in a central compartment 120 of casing 25. Two side compartments, 110 and 140, accommodate laterally movable flap connectors 105 and 145, respectively. Compartments 110 and 140 are provided with side slits 114 and 141, through which flap 1 can slide in and out. In accordance with the embodiment shown here, flap 1 is retractably mounted at one side of casing 25 (compartment 110) and having its free end provided with a quick male connector for connecting into complementary female connector in compartment 140. This flap fastening arrangement allows for quick and simple adjustment of the flap to the size of the limb and for exerting primary pressure on the tissues. Accordingly, connector 105 includes a vertical rod 102 rotatably mounted between two horizontal beams 116 and 117, allowing rod 102 to revolve around its axis for rolling/unrolling flap 1. Flap 1 is affixed to rod 102 at one end and is wound around the rod. Rod 102, acting as a spool for flap 1, is provided with a retraction mechanism (not shown). The retraction mechanism can be any spring loaded retracting mechanism or any other retraction mechanism known in the art, such as are used with seat belts, measuring tapes and the like. For example, the retraction mechanism can comprise a spiral leaf spring having one end secured to rod 102 so as to present torque on the rod when flap 1 is withdrawn and to cause the flap to roll back once its free end is released. The upper end of rod 102 terminates with head 115 and a cap 116 of a larger diameter mounted on springs 118. The inner surface of cap 116 fits onto outer surface of head 115, such that when cap 115 is pressed downward, it locks head 115, preventing free rotation of rod 102 and consequently preventing flap 1 from being rolled or unrolled. The second free end of flap 1 terminates with buckle 111 which fits into a complementary accepting recess 142 of connector 145 for allowing quick connection into the second side of casing 25. In the example illustrated here, buckle 111 has an arrow shape while connector 145 has a complementary arrow shape recess 142 provided with slanted protrusions 144 mounted on springs 146. When buckle 111 (duplicated on the right side of FIG. 6 for description sake only) is pushed toward recess 142, protrusions 144 are pressed aside, and then fall behind the arrow head of buckle 111, locking the buckle. Movable connectors 105 and 145 are coupled to the machinery components by means of horizontal rods 106, which extend through openings 103 into central compartment 120 and are in contact with disk 128 perimeter. Horizontal rods 106 terminate with bearings 109 which allow the rods to smoothly slide along disk 128 perimeter as the disk revolves around its axis. Thus, the distance between rods 106, and consequently the periodical change of the circumference of the loop encircling the limb, mimics the outline shape of disk 128. In order to maintain constant contact between bearings 109 and disk 128 and to facilitate fast transition between flap relaxed to contracted position, rods 106 are mounted on biasing springs 108 positioned between walls 105 and are provided with plates 107 perpendicular to the rod axis and pressed against springs 108. Thus, springs 108 bias connectors 105 and 145 in the inward direction toward each other. As disk 128 revolves around its axis, springs 108 are compressed by plates 107 in accordance with disk 128 varying radius. When disk 128 rotates to the point where cusps 129 simultaneously face bearing 109, rods 106 momentarily lose contact with disk 128 and the potential energy stored in springs 105 is released, pushing rods 106 inwardly. This causes a sudden inward pulling of flap 1 by both rods 106, leading to sharp squeezing of the limb tissues. It will be easily realized that the length interval between contracted and released states of the limb encircling loop, and hence the squeezing force exerted on the tissues, is directly proportional to the radius change at cusp 129. Following the sudden flap contraction, the rods are gradually pushed outwardly leading to flap relaxed mode which lasts for substantially half a cycle. Hence, one revolution of disk 128 around its axis results in two fast flap contractions. Typically, the transition from relaxed to contacted position takes about 0.5 seconds, the transition from contracted to relaxed position takes about 5 seconds and the relaxed position is maintained for about 50 seconds. However, it will be easily realized that the perimeter of disk 128 can be shaped such as to obtain any desired contraction-relaxation cyclic pattern. The device is further provided with an on/off switch 130 comprising button head 132, electrical connector 134 made of electric conductive material, and a bottom protrusion 136. When switch 130 is pushed to the left by means of head 132, connector 134 closes the electric circuit (shown in broken line), setting the machinery into action. Simultaneously, protrusion 136 presses cap 116 downward, locking head 115 and preventing rod 102 from turning around its axis, for fixing the available length of flap 1. Button 132 can be further provided with a force regulator for regulating the frequency. A different embodiment of the present invention in which box assembly 2 is the active intermittent compressing part is depicted in FIG. 2B. According to this embodiment, assembly box 2 further comprises a compressing plate 3 lying substantially parallel to casing 25 at a predetermined distance from its surface. According to this embodiment, the assembly 2, more specifically said compressing plate 3 is pressed against the tissue and intermittently extend and retracts from casing 25 thus producing intermittent compression of the calf tissue. According to this embodiment flap 1 is connected to casing 2 by two fixed slit latches, such that at least one end of flap 1 is threaded through one of latches 68 and is folded onto itself to allow comfortable fitting, as described in conjunction to FIG. 2B. An on/off switch 6, a power regulator 5 and a rate regulator 7 are located at the top of the device in the same fashion as in FIG. 2B.

Figure 7:
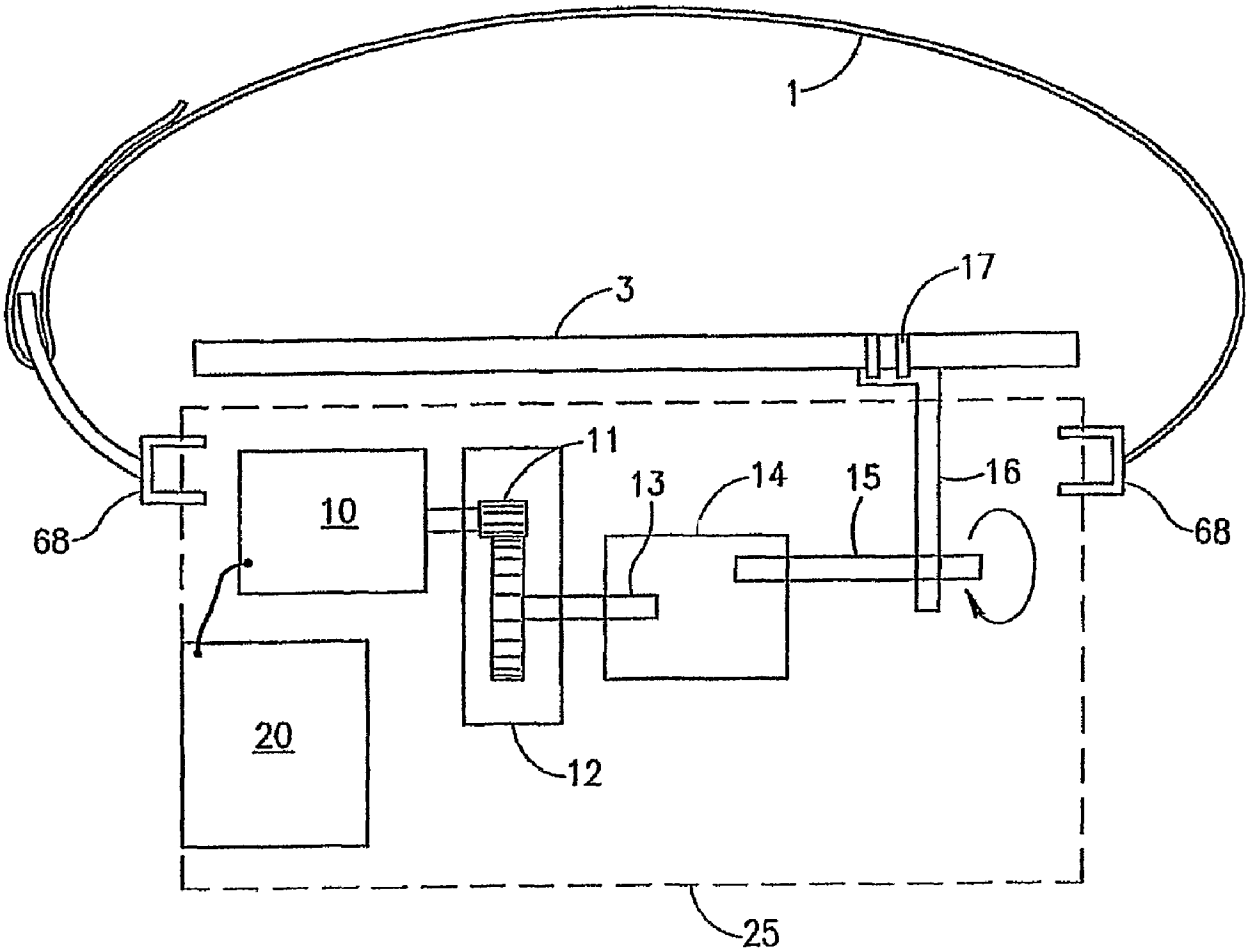
FIG. 7 is a top view of a device in accordance with the anterior box embodiment of FIG. 2B showing the internal mechanism of the assembly box.

A top view of a machinery embodiment in accordance with the device embodiment of FIG. 2B is shown in FIG. 7. A power source 20 powers an electrical motor 10 that has a centrally located shaft 11. Said centrally located shaft 11 is coupled to a velocity reduction gear 12 which reduces the spinning velocity of the rod 11 and increases the power output. Reduction gear 12 has a centrally located rod 13 that is connected to drum 14 that has an eccentric located rod 15. The eccentric located rod 15 is connected perpendicularly to the longer arm of a motion transfer L-shaped bar 16, wherein the shorter arm of said L-shaped bar 16 is connected to compressing plate 3 by connection means 17. Connection means 17 may be for example bolts, pins, screws etc.

Electrical motor 10 converts electrical energy into kinetic energy stored in the spinning of the centrally located rod 11. The kinetic energy stored in the spinning of the said centrally located rod 11 is converted into power by the said velocity reduction gear 12. The power stored in the said centrally located rod 13 connected to the said velocity reduction gear 12 is converted to the rotation of the said drum 14 which has the said fitted eccentrically located rod 15. The circular motion of the said eccentrically located rod 15 is transferred to the extension and retraction of the said compressing plate 3 via the said motion transfer rod 16 and connection means 17.

According to this arrangement, the circular motion of the eccentrically located rod 15 is transferred into periodical motion of plate 3. Said periodical motion of plate 3 is a combination of a first periodic motion in the extension-retraction direction (i.e., increasing and decreasing the distance between plate 3 and casing 25) as well as a second periodic motion which is perpendicular to said first periodic motion. (In accordance with FIG. 6, this second periodic motion is in a direction perpendicular to the drawing surface). Thus, further to the obvious effect of applying intermittent compression on the limb by the extension-retraction motion of plate 3, the present embodiment also imparts the device a "massage-like" effect, thus enhancing the squeezing efficacy.

It will be easily realized by persons skilled in the art that the embodiments described in FIGS. 3-7 are only examples and that different features described separately in conjunction with a particular embodiment, can be combined in the design of a device of the present invention. For example, a retractable flap feature as illustrated in FIG. 6 can be combined with any of the other embodiments. Much the same, an asymmetrical component such as disk 128 of FIG. 6 can be added to any of the other embodiments for allowing a particular pattern of a contraction-relaxation cycle.

Figure 8:
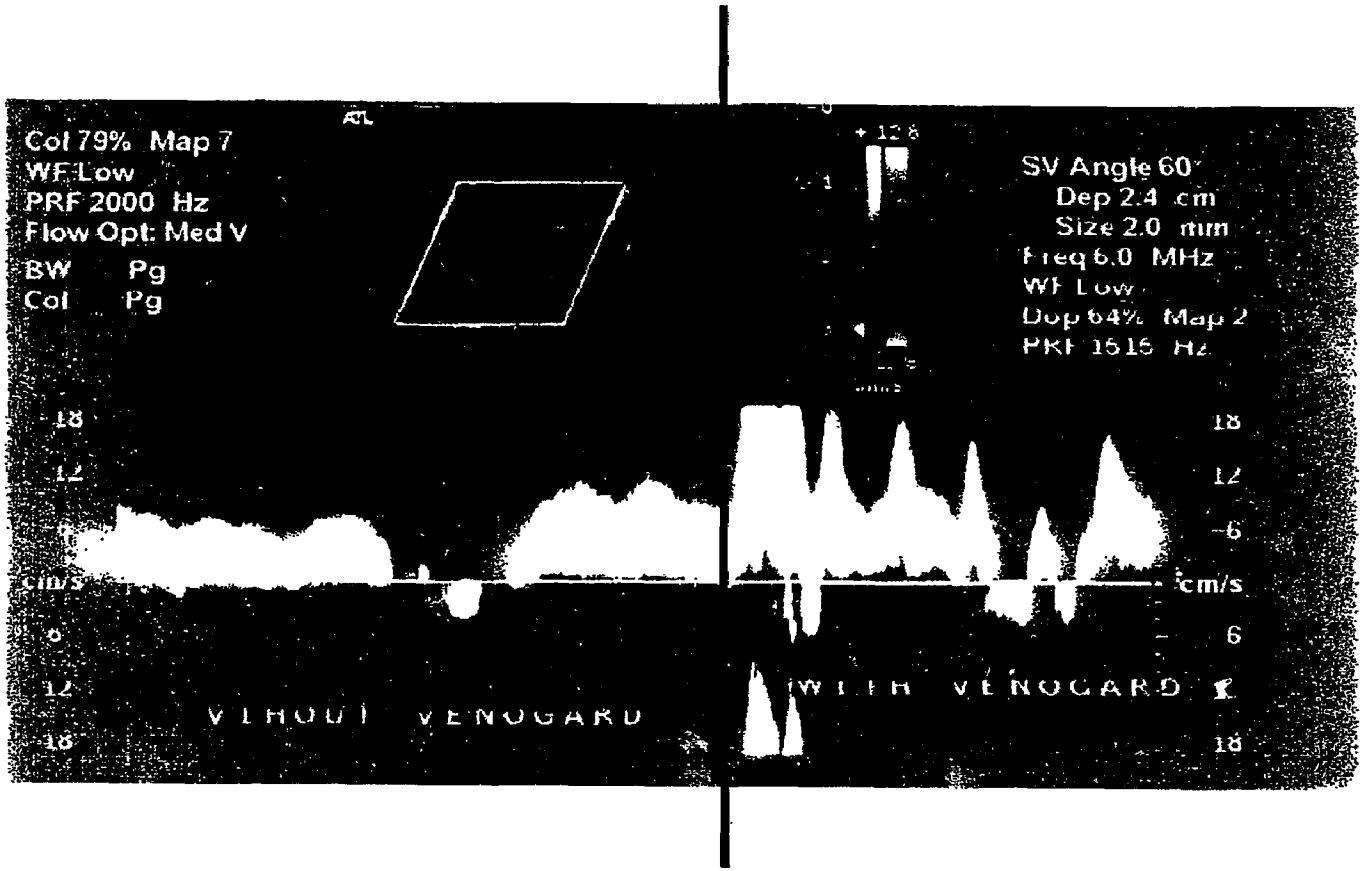
FIG. 8 shows exemplary Doppler ultrasound test results obtained by the application of the present invention.

FIG. 8 shows all exemplary Doppler ultrasound test results obtained by the application of the present invention. The results shown here were obtained by applying a device in accordance with the embodiment of FIG. 6 on a 49 years old healthy woman in the supine position. The device was applied to the right thigh close to the groin. The right side of FIG. 8 is a Doppler ultrasound measurement of the patient just before the activation of the said device. The white areas represent the blood flow in the deep veins of the thigh. These white areas are taken here as baseline for this subject. The blood flow in the deep veins of the same subject is illustrated in the left picture of FIG. 8 immediately after the said device was put to action. FIG. 8 clearly shows the immediate enhancement in the venous blood flow above the said baseline upon operation of the device as depicted by higher peaks of white areas. The above Doppler Ultrasound example displays the efficacy of the present device.

In addition to the examples shown above, it will be apparent to the person skilled in the art that the device of the present invention can be readily used for the enhancement of blood flow in many situations. Such include persons sitting or laying for long periods of time (for example, during long air flights or car travels or long hours working at the sitting position or immobilization at the hospital or rehabilitation center and the like.) It will be apparent that it may also be used for the enhancement of blood flow of a patient with diseases such as Diabetes Mellitus and Burger's disease. Also, for the enhancement of lymph flow in the hand of a patient post mastectomy. Other uses not described here above will be apparent to the person skilled in the art. Providing said examples is made for the purpose of clarity and not limitation.

Figure 9:
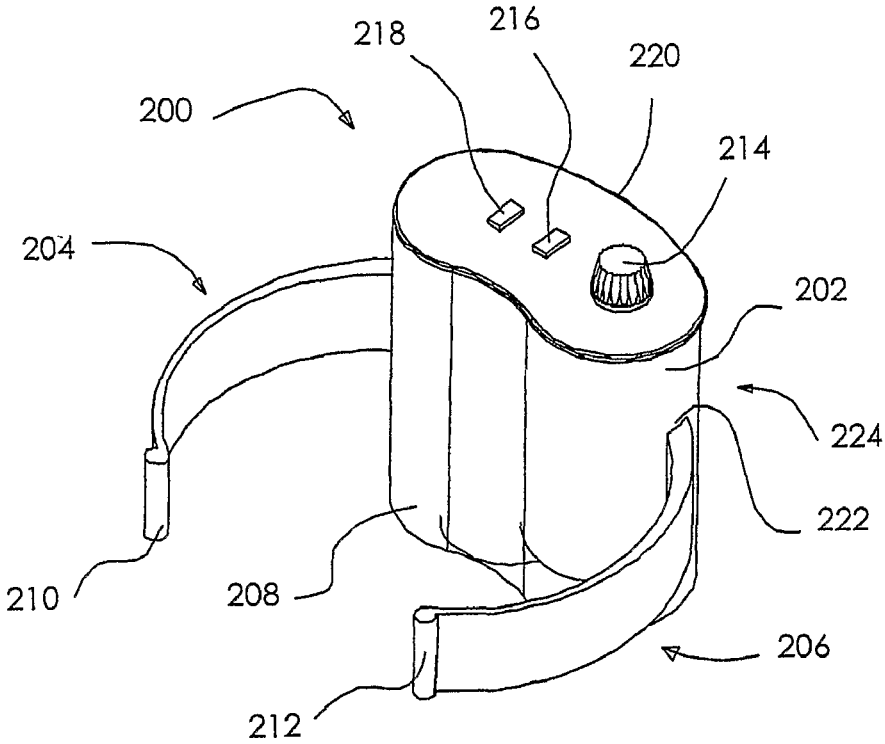
FIG. 9 is a side external view of another preferred embodiment of the present device, in which squeezing the limb muscles is performed by rounded flaps.
Figure 10:
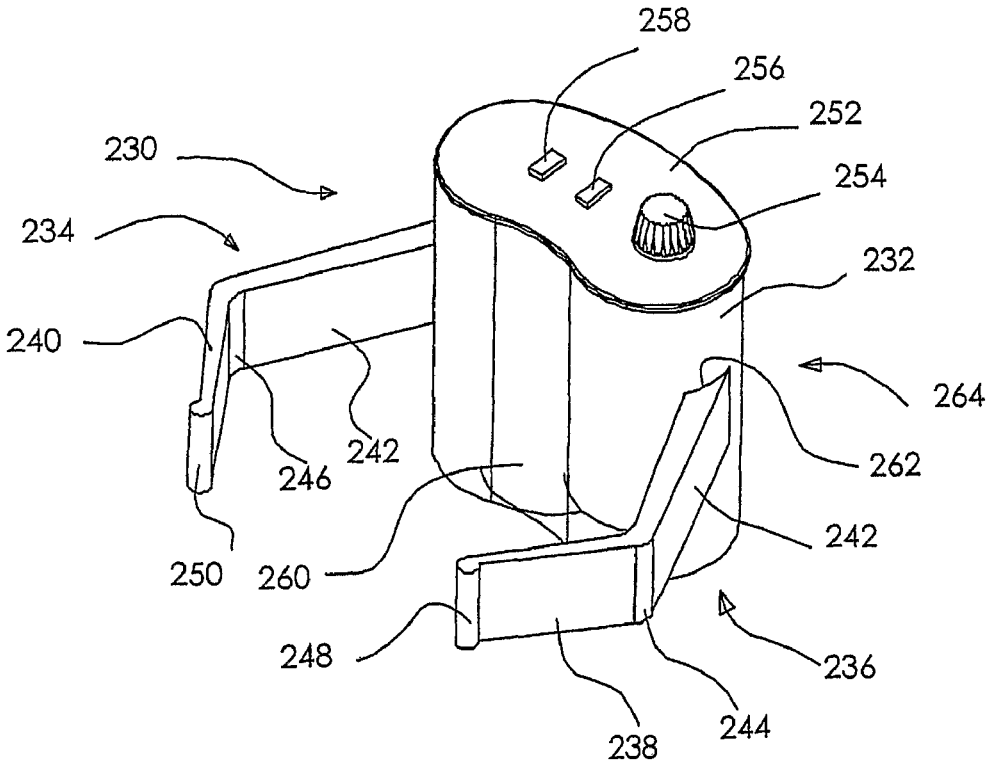
FIG. 10 is a side external view of a further preferred embodiment of the present device, in which squeezing the limb muscles is performed by angled flaps.

FIGS. 9 and 10 are additional preferred embodiments according to the present invention. As can be seen in FIGS. 9, 10 instead of a flexible strap, rigid flap or semi-rigid flaps providing a substantial hold of the device on the limb of the patient and allowing the use of the device are disclosed. The flaps can have various shapes and are designed such that they do not encircle the patient limb, thus allowing the patient or user to easily place and remove the device on and from the limb. The patient can hold the flaps or the device when applying the device to the limb. FIG. 9 and FIG. 10 depict device 200 and device 230, respectively. Devices 200, 230 provide periodically compression and squeezing of a limb for promoting the increase of blood and lymph flow in the limb as is described in accordance with the figures above. Similarly to the above depicted embodiments devices 200 and 230 can provide periodical changes between contracted and relaxed states. Furthermore, according to the mechanisms used within devices 200 and 230 different time periods in each state and between each state can be provided to suit the particular result or effect sought by the user.

In a preferred embodiment device 200 of FIG. 9 is a portable device for enhancing or modulating circulation of blood or lymph flow in the a limb and in the body in general. The device comprises an actuator and one or more rigid or semi-rigid flaps associated with said actuator. The actuator can be a motor or a pneumatic pump or any other energy driven actuator able to provide controlled periodical movement to change the position of the flaps relative to the limb of the user. The change of position of the flaps results in the periodical and intermittent actuation of the limb through applying squeezing forces on the limb. The actuator changes the position of the flaps in a direction such that the limb to which the device is attached is compressed periodically and intermittently. The flaps are comprised from a rigid and/or semi-rigid material and encircle at least a part of the user's limb such that the device can be substantially attached to the limb of the user and that the device can provide intermittent modulation of the limb or of the limb's properties (such as shape, dimension, pressure and the like) of the user. In the preferred embodiment, thee device 200 comprises an actuator (not shown) within an optional assembly box 224, and flaps 204 and 206. Flaps 204, 206 are rigid or semi-rigid sections formed in an angle allowing the holding of the limb. The flaps shown in association with FIGS. 9, 10 can be provided in various shapes and angles to best hold the limb, yet not to encircle the circumference of the limb and allow the patient to attach the device 230 to the limb and as easily remove the device 230 there from. The actuator can be located within assembly box 224 or external thereto. For example, the actuator can be a pneumatic pump or a motor attached to the belt of the user transferring power through a power transferring element conduit such as an air pipe, or a rotating flexible screw, pulling wire, and the like. Persons skilled in the art will readily appreciate the other locations at which the actuator can be placed or hanged remotely from the device comprising the flaps. Thus, if the actuator is hanged for example on the belt of the user and in a non-limiting example a pneumatic pump transfers air to change the position of the flaps, the device comprising the flaps can be significantly smaller and lighter.

Device 230 shown in FIG. 10 comprises an actuator (not shown) within said assembly box 264, and flaps 234 and 236. As noted above said actuator provides power such as movement power to periodically and intermittently actuate the flaps providing intermittent squeezing forces on the limb, thus modulating the blood and lymph flow in the limb. Devices 200 and 230 can also correlate to the anterior box embodiment depicted above in view of FIGS. shown and discussed above.

Still referring to FIGS. 9, 10 assembly boxes 224, 264, respectively, are placed against a calf bone of a limb and flaps 204, 206 and flaps 234, 236 partially encircle the limb's circumference, thus said flaps are placed against the tissues. Thus, device 200 comprises with assembly box 224 and flaps 204 and 206 a partially open loop 229. Similarly, device 230 comprises with assembly box 264 and flaps 234 and 236 a partially open gap 270. According to other embodiments of the present invention assembly boxes 224 and 264 can be placed against the muscles correlating to the posterior embodiment mentioned above.

Assembly box 224 of FIG. 9 comprises, casing 202 that further comprises an on/off switch 218, a force regulator 216 for regulating the force exerted on the calf tissue by flaps 204, 206 and a rate regulator 214. Casing 202 comprises also a curving 208 that enables comfortably positioning of casing 202 against tissue of a limb according to the invention. Casing 202 further encases a mechanism (not shown) and a power source (not shown) that both enable device 200 to perform periodically squeezing of tissues for promoting the increase of blood and lymph flow in the limb (not shown). The squeezing of tissues performed by device 200 is performed by applying a movement of one or both flaps 204, 206 in and out of casing 202 by the mechanism. The movement of one or both flaps 204 and 206 provides a periodically squeezing and relaxation of the tissue adjacent to the moving flap. The mechanism and the power source used for generating the movement of flaps can be any of the mechanisms and power sources described above regarding the other embodiments or in pending U.S. patent application designated Ser. No. 10/469,685 titled "A PORTABLE DEVICE FOR THE ENHANCEMENT OF CIRCULATION AND FOR THE PREVENTION OF STASIS RELATED DVT" and filed 3 Sep. 2003. Flaps edges 222 and 226 (not shown) can be both connected to a mechanism within casing 202. The portion of flaps 204 and 206 connected to the mechanism moving during the operation of device 200 can be very small. The movement of flaps 204 and 206 in and out of casing 202 provides that a small portion of flaps is inserted in casing 202 during the squeezing state and similarly a small portion is pushed out of casing 202 during the relaxation state. Thus, the change of the exposed flaps parts adjacent to the tissues provides the intermitted squeezing of the tissues of the limb. Alternatively, one edge 222 or 226 is connected to any of mechanism depicted above while the other edge is fixed to casing 202. Flaps 204 and 206 according to the present embodiment can be fabricated from light metal, a metal alloys, an elastic polymer, a combination thereof or any other material that is non irritating and preserves its rigid or semi-rigidity quality under the squeezing of the limb. One example of light metal used can be a light weight aluminum metal alloy. The aluminum metal alloy used can be the only fabrication material of the flaps 204 and 206, alternatively, the alloy can be used only in one part of flaps, two parts of flaps 204, 206 or along all of flaps 204 and 206 as a combination with other materials. The metal alloy can be coated with a fabric to provide comfortable sensation to the patient. One embodiment positioning two parts of metal can be by positioning one section of metal at edges 222 and 226 and other metal sections of flaps 204 and 206 at the other ending. According to the present embodiment flaps 204 and 206 are separated by gap 228. Each of flaps 204 and 206 is rounded and performs an arch shape or a like shape. The arch rounded shape of flaps 204 and 206 provide a comfortable and firm holding of a limb. Furthermore, the arch rounded shape of flaps 204 and 206, gap 228 together with casing 202 comprising curving 208 provide a device 200 that can be easily adjustable to different limbs. Thus, device 200 can be easily adjusted to different limbs having different circumferences. The fabrication quality of flaps 204 and 206 ensures that the holding of the limb will be firm even though not encircling the entire circumference of the limb. Flaps 204 and 206 are rigid and preserve their rounded shape during the operation of device 200 thus, ensuring the squeezing force activated by mechanism within casing 202 is determined only by the mechanism and not subject to deformation of flaps 204 and 206. Positioning of device 200 on limb can be performed by applying force on flaps 204 and 206 by bending each flap to the opposite direction of their rounded curving. The bending is required to provide sufficient cross section space between edges 210 and 212 to position or disposition device 200 from a limb. Alternatively, only one of flaps 204 and 206 is bended in the direction opposite to its curving direction. Subject to the fabrication material of flaps 204 and 206 bending of flaps 204 and 206 does not deform the arch shape curving and does not change the rigid qualities of flaps 204 and 206. The bending provides sufficient cross section to position casing 202 and curving 208 on calf bone of a limb. Accordingly, flaps 204 and 206 return to their relaxed position as shown in FIG. 9 after ceasing to apply the bending force. Ceasing to apply the bending force on flaps 204 and 206 fixes device 200, thus device 200 is held attached to the limb without activation of mechanism. Alternatively, positioning or removal of device 200 from limb can be by releasing one or two of flaps 204 and 206 by a knob (not shown) positioned on casing 202. One example can be a knob that encounters with flap 206 and fixes flap 206 in its position in casing 202. Pressing the knob releases flap 206 and provides flap 206 a free movement. Accordingly edge 222 remains in its position attached to casing 202 but is provided with a possibility to motion in the substantially the same virtual plain created by flaps 204 and 206. Flap 206 is pulled apart from flap 204 and provides sufficient space to position curving 208 on a tissue of a limb. After placing curving 208 on tissue, flap 206 is returned to its position as shown in FIG. 9 and the knob (not shown) returns to its initial position. According to the example, the position of flap 206 is held by the knob that upon placing of flap 206 in its position the knob does not provide any free movement of flap 206. Flaps 204 and 206 have rounded edges 210 and 212, respectively. Rounded edges 210 and 212 provide that no possible cuts can occur as result of using device 200. The flaps shown 204, 206 can span the full length of the casing 202 thus allowing a better grip of the patient's limb during the operation of the device.

Device 230 shown in FIG. 10 is a further embodiment of a device according to the present invention. Device 230 comprises assembly box 264 and flaps 234 and 236. Assembly box 264 comprises, a casing 232 that further comprises an on/off switch 258, a force regulator 256 for regulating the force exerted on the calf tissue by flaps 234, 236 and a rate regulator 254. Casing 232 comprises also a curving 260 that enables comfortably positioning of casing 232 against calf bone of a limb according to the invention. Casing 232 further encases a mechanism and a power source (both not shown) that enable device 230 to perform squeezing of tissues for promoting the increase of blood and lymph flow in the limb (not shown). The squeezing of tissues performed by device 230 is reached by applying a movement of flaps 234 and 236 in and out of casing 232 by the mechanism or, alternatively, movement of only one of flaps 234 and 236 in and out of casing 232. The portion of flaps 234 and 236 connected to the mechanism moving during the operation of device 230 can be very small. The movement of flaps 234 and 236 in and out of casing 232 provides that a small portion of flaps is inserted in casing 232 during the squeezing state and similarly a small portion is pushed out of casing 232 during the relaxation state. Thus, the change of the exposed flaps parts adjacent to the tissues provides the intermitted squeezing of the tissues of the limb. Similar to the embodiment depicted in view of FIG. 9 the mechanism and power source used for generating the movement can be any of the mechanisms and power source used and depicted above or in co-pending U.S. patent application designated Ser. No. 10/469,685 titled "A PORTABLE DEVICE FOR THE ENHANCEMENT OF CIRCULATION AND FOR THE PREVENTION OF STASIS RELATED DVT" and filed 3 Sep. 2003. Thus, edges 262 and 266 (not shown) of flaps 236 and 234, respectively, penetrate casing 232. According to the mechanisms used in device 230 either one or both of edges 262 and 266 are connected to a mechanism that generates the squeezing and relaxation states on limb. Flaps 234, 236 provide two angled shape flaps that are enabled to grip firmly a limb (not shown). Persons skilled in the art will appreciate that the flaps 234, 236 can be fabricated having more than two angled shapes. In the embodiment shown, flap 234 comprises two substantially straight and flat elements 240 and 242. Elements 240 and 242 form curve 246. Elements 240 and 242 form with curve 246 an angle that can be about 90° or larger. Similarly to flap 234 also flap 236 comprises elements 238 and 239 forming curve 244 with an angle that can be about 90° or larger. In a multi segment and angled shape flaps the angle between each segment of the flaps can vary according to the number of segments used and in accordance with the desired shape to be used. Some embodiments of the present invention may include different shapes and variable number of segments to allow treatment of patients with abnormal extremities shape or accommodating various sizes of limbs. For example, a very large limb can be accommodated by provided a four or five segments flaps with wide angles allowing the application of the device to a larger than normal limb. Another example would be to allow multiple segment flaps having narrow angles to fit small limbs (such as with children or patients whose muscle volume has been decreased). The fabrication material of flaps 234 and 236 can be the same as depicted in view of FIG. 9. Flaps 234 and 236 form gap 268. Gap 268 enables to easily position and remove device 230 from limb. Flaps 234 and 236 comprise rounded edges 250 and 248, respectively. Rounded edges 250 and 248 provide a shape that will not harm a limb when positioning or removing device 230. Positioning and removing of device 230 can be performed as depicted in view of device 200 of FIG. 9.

Figure 11:
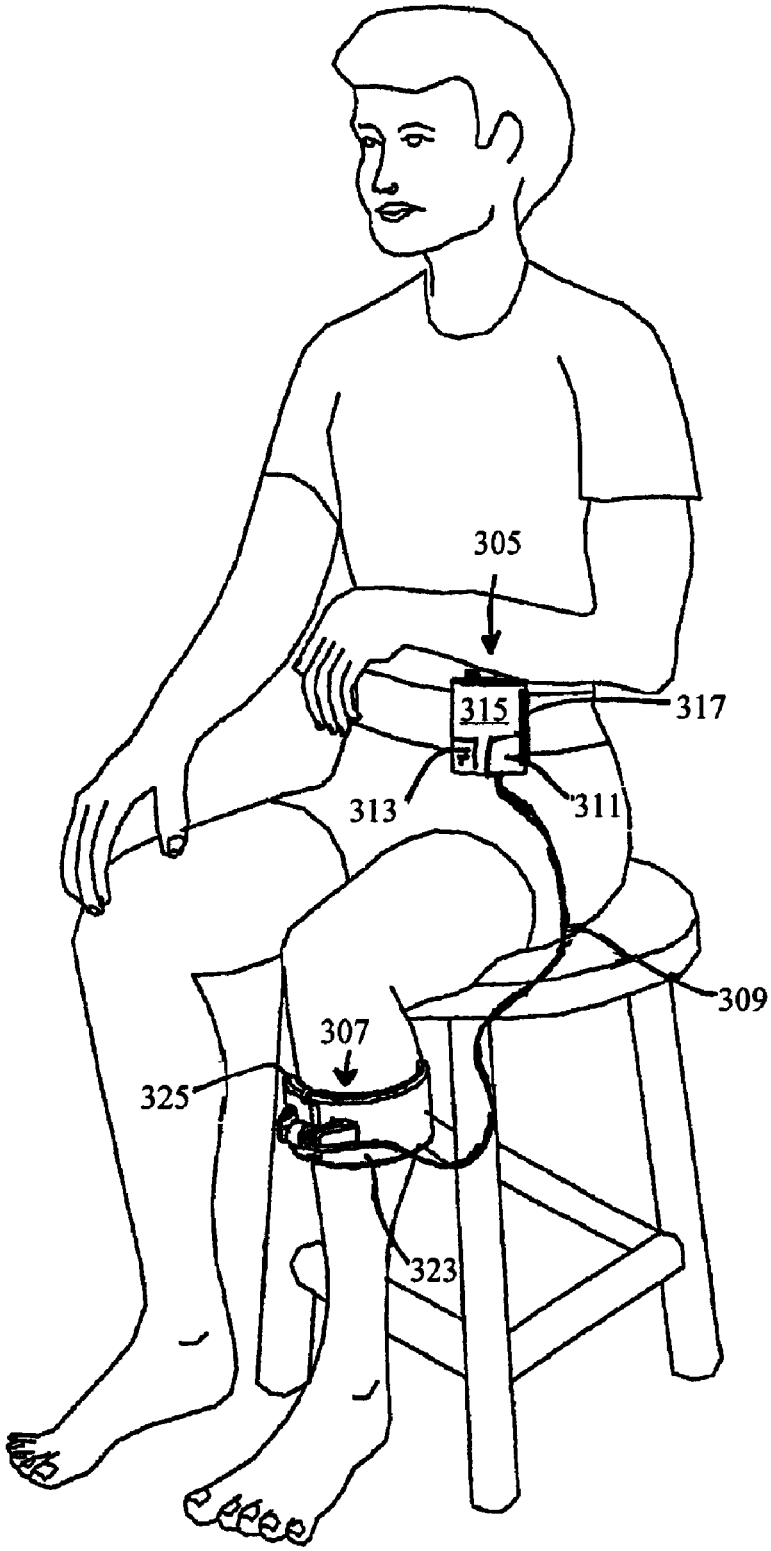
FIG. 11 shows a pictorial representation of device for modulating the blood and lymph flow in a limb having two remote elements, in accordance with another preferred embodiment of the present invention.
Figure 12:
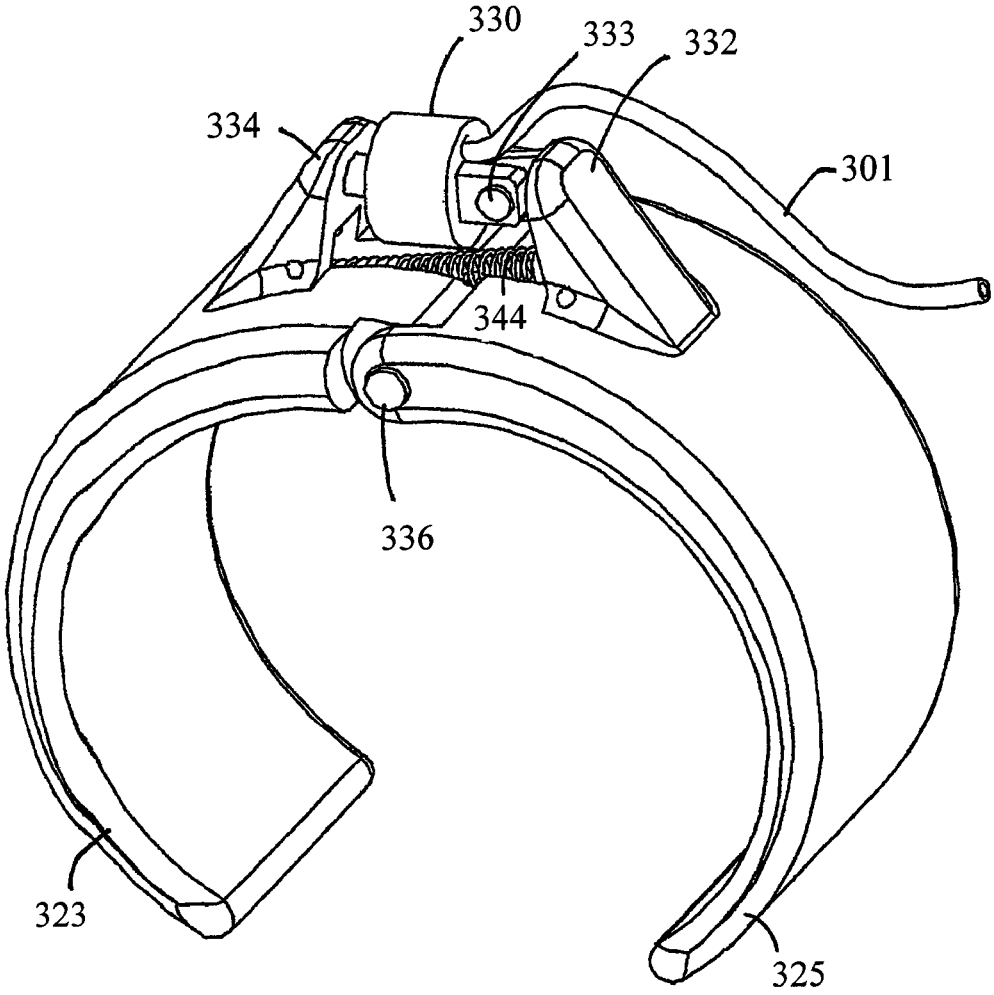
FIGS. 12 and 13 show a side external view of the compressing element of the device for modulating the blood and lymph flow in a limb having two remote elements, in accordance with another preferred embodiment of the present invention.
Figure 13:
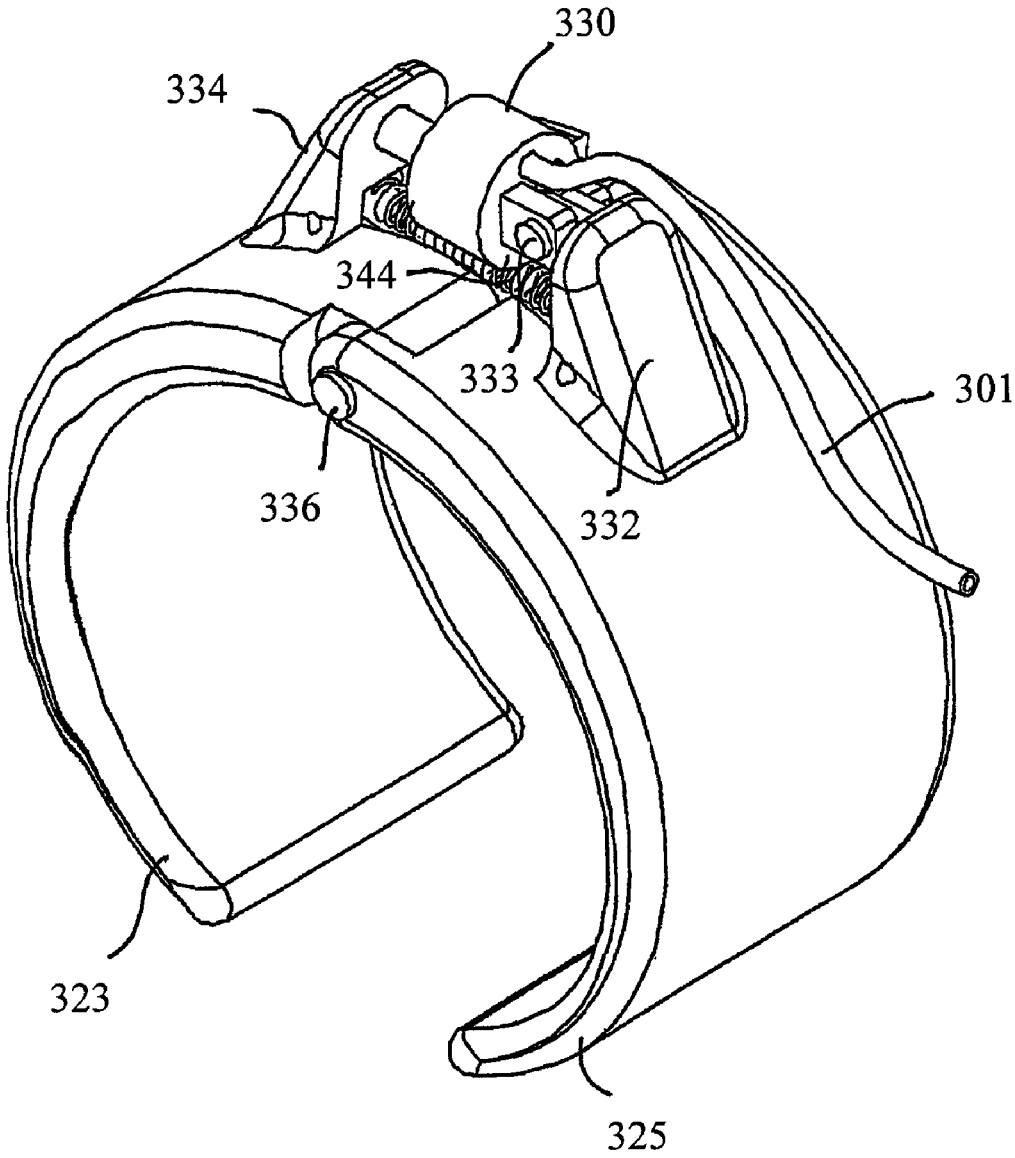

Referring now to FIGS. 11, 12 showing a device for modulating the blood and/or lymph flow in a limb having two remote elements. In FIGS. 11, 12 like numeral refer to like parts. In the present embodiment, the device for modulating the blood and lymph flow in a limb comprises two associated elements. The first element is provided for generating the power required to provide intermittent compressing to the limb or movement forces to be applied through flaps or straps to a limb. The second element comprises an energy transforming element and one or more straps or flaps providing compressing forces to the limb so as to enable the modulation of the blood or lymph flow in the limb. The first and the second element are associated there between via a conduit for transferring said power from the first to the second element. The device 300 comprises an actuating element 305 and a compressing element 307 associated there between via conduit 309. The actuator 305 can comprise an actuator 311 such as a pneumatic pump generating compressed air to be delivered via conduit 309 to the compressing element 307. In alternative embodiments the actuating element can comprise a motor and associated machinery to generate transferable energy via conduit 309 to compressible element 307. In yet another alternative the actuator can be a compressed gas or fluid container to generate energy through the release of said contained gas or fluid, or the like mechanisms or actuators allowing the generation or release of energy to be transported from the actuator 311 to the compressing element 307 via conduit 309. The actuating element 305 can also comprise an energy source such as a battery 313 to provide power to the actuator 311. The actuator 311 can be placed in a housing 315 to which a buckle or clip 317 can be attached so as to enable the easy fastening of the actuating element 305 to a belt on the garment of the user or to another garment worn by the user. Alternatively, the actuating element can be hanged on the body of the user or held by hand. The conduit 309 can be a plastic or other rigid, semi-rigid or flexible line in which the power generated by the actuator can be transferred to the compressing element. In one embodiment of the present invention the conduit 309 is a plastic pipe transferring compressed air generated by the actuator 311. In an alternative embodiment the conduit 309 is a pipe housing a revolving flexible element transferring energy from the actuating element 305 to the compressing element 307. The compressing element comprises an energy transforming mechanism to receive movement power from the actuator and translate said energy to movement of the flaps 323, 325 in a direction such that the flaps apply squeezing forces on the limb. The compressing can be housed in an assembly box (not shown). The energy transforming mechanism can include a spring or an inflatable bladder or a mechanism comprising cogwheel and rods and the like, the mechanism receives the energy transferred via conduit 309 and transforms the energy into movement force. In the present non-limiting example, the energy transforming mechanism is an inflatable bladder 330 which is inflated and deflated periodically through compressed air transferred via conduit 309. When compressed air enters bladder 330 causing it to inflate and push outwardly levers 332, 334 inversely connected through pivot 336 so as to reverse the movement power from the outward direction to the inward direction resulting in flaps 338, 340 applying compression on limb (not shown). To allow movement of levers 332, 334, lever 332 is connected to bladder 330 via pivot 333 allowing levers 332, 334 to be pushed outwardly on an angular course to be defined by the positioning of pivots 333, 336 and the ability of bladder 330 to inflate and deflate. As can be seen in the present figures the compression can be applied intermittently or continuously to the limb of the user, the pressure applied dependant on the air pressure transferred to the bladder 330 and the ability of the bladder to expand and the levers 332, 334 to extend outward. When used in an intermittent cycle, air is transferred to the bladder 330 periodically. A release valve (not shown) automatically or manually releases the air in bladder 330. Return spring 344 is juxtaposed between bottom sides of levers 332, 334, but above pivot 336 to avoid contact with the limb of the user forces. Return spring 344 is charged by energy accumulated there within as a result of the movement of the flaps 323, 325 outwardly. When the bladder 330 is deflated as a result of the opening of the valve (not shown) the return spring stored energy is released such that the levers are moved inwardly. The return spring may also be located above said bladder to allow enhanced use of the energy stored in said return spring. The return spring may be housed in a protective cover to enable safe operation. The inward contracting force exerted by return spring 344 results in movement that in turn causes levers 332, 334 to further compress bladder 330 and assist in the expulsion of remaining air there within. At a predetermined time, or in accordance with the selection of a user of the device, the valve (not shown) closes and compressed air can be redirected towards bladder 330 for an additional cycle of inflation and compressing of the limb. As is described in association with the above drawings, the transition from a contracted to a relaxed state can be slow or fast and likewise the transition from a relaxed to a contracted state can be slow or fast. The length interval of the transitions, as well as of the contracted and relaxed states is preferably regulated by a regulator (not shown) to be attached to either the compressing element or to the power generating element. The regulator can be programmed with various plans for intermittent compression of the limb, allow uneven or numerous durations for each compressed or relaxed states, the speed of compression or relaxation, the length of each interval between states and the number of cycles to be performed by each plan. In another alternative non-limiting example, the compressing element comprises any one of the machineries disclosed herein above in association with the various figures presented in the present invention, to include without limitation, motors, speed reducing wheels, cogwheels, rods and shafts that allow the pulling and releasing of a strap or the changing if position of one or more flaps so as to allow compression of the limb of the patient or user.

Persons skilled in the art will appreciate that any of the above mentioned embodiments can be implemented in the compressing element structure and the actuator structure. Persons skilled in the art will also appreciate that the components used in association with the description above are examples of components that can be used to make and use the invention; such examples or any combination thereof should not be construed so as to limit the invention rather to clearly explain the preferred embodiments of the invention.

According to other embodiments of the present invention flaps can be substantially fixed and attached to a casing of a device juxtaposed to a limb. The device comprising the substantially fixed flaps provides a periodical transfer between a contracted and a relaxed state by employing a mobile plate such as depicted above in view of FIG. 2B. Subject to the flaps which are rigid or semi-rigid and providing a substantial hold of the device on the limb the intermittent motion of the mobile plate actuates an intermittent squeezing and releasing of a limb. Thus, actuation of the mobile plate towards said limb actuates force towards said limb and employs concurrently opposite force vectors by said flaps holding said limb. The force employed by flaps provides squeezing of said limb. Other embodiments of the device comprising substantially fixed flaps are provided with a pneumatic cell or bladder replacing said mobile plate. Accordingly, a device will comprise a mechanism providing intermittent inflating and deflating of said cell or bladder. The intermittent inflating and deflating cycle provides intermittent squeezing and releasing of a limb. Thus, the inflated bladder comprising gas (e.g. air) employs force on said limb and concurrently the flaps employ squeezing of the circumference of limb juxtaposed to flaps.

The inflating and deflating of bladder as well as the motion of said moveable plate can be performed by a mechanism (i.e. a motor) comprised within said device. The mechanism comprising a power source can comprise also pump, a mechanical mechanism (e.g. a spring or other means), a hydraulic mechanism, an aerosol, an electrical or magnetic engine, a combination thereof or other.

The mechanism described in association with the drawings above can also comprise an energy chargeable element operatively disposed between the motor and one or both flaps. Such energy chargeable element was described in detail in Israel Patent application to which a serial number has not yet been assigned filed 16 Aug. 2004 titled A DEVICE FOR PROVIDING INTERMITTENT COMPRESSION TO A LIMB, the content of which is hereby incorporated by reference. The energy releasing mechanism is coupling between the energy chargeable element and the flaps, said energy releasing mechanism enables fast release of energy stored in the chargeable element and the use of the energy so released to effectuate one or more abrupt transition between the relaxed and strained or contracted states. In a preferred embodiment of the present invention the abrupt transition is of less than about 10 seconds, or less than 1 second, or less than 300 msec, or less then 30 msec. The abrupt transition can be the transition from a contracted to a relaxed state, or the transition from a relaxed to a contracted state. To regulate the abrupt transition, the device can also comprise a frequency regulator, the function of which is to regulate the length of time for the abrupt transition.

One skilled in the art can appreciate that different flaps can be used substituting the flaps depicted above. Other embodiments of the present invention can comprise only one flap that is long enough to grip a limb and is connected to a casing on one end and forms a gap between casing and flap on the other end. According to other embodiments flaps used in one device may not be the same size, may not be the same shape, or may not have the same fabrication material. The flaps used may have different shapes and can be wide and narrow in one or more places along the flap. Additionally, other flaps with other shapes can be provided such as a flap having more than two straight elements as depicted and shown in FIG. 10. Additionally, the gap formed by flaps can be smaller or larger depending on the fabrication material, the strength of grip required for limb and other parameters. According to other embodiments the gap can be very small and not easily visible.

The reader's attention is directed to all documents and papers that are filed concurrently with the present specification and which are or will become open to public inspection with this specification, and the contents of such papers and documents are incorporated by reference herein. All the features disclosed in the specification, including the appending claims, abstract and drawings, may be replaced by alternative features serving the same equivalent or similar purpose, unless expressly stated otherwise. Although the present application has been described in considerable detail with reference to certain preferred embodiments, other embodiments and versions of those embodiments are possible and will not depart from the spirit or scope of the present invention.

The same spirit and scope of the appended claims should not be limited to the description of the preferred embodiments contained herein.

I claim:

1. A portable device for modulating blood or lymph flow in a limb, the device partially encircling said limb, the device comprising at least one flap and an actuator coupled to said at least one flap to provide a controlled periodical movement of said at least one flap relative to the limb for applying periodical squeezing forces on the limb;

wherein said actuator comprises:

a motor or a compressor;

at least one spring operatively disposed between the motor or compressor and the at least one flap; and at least one energy applying mechanism coupling between said at least one spring and said at least one flap for enabling fast release of energy stored in said spring and the use of the energy so released to effectuate at least one abrupt transition between relaxed and compressed states of the limb.

2. The device of claim 1 wherein the limb is a leg and wherein said at least one flap is shaped to conform to a leg curvature.

3. The device of claim 1 wherein the at least one flap is rigid.

4. The device of claim 1 wherein the at least one flap is semi-rigid.

5. The device of claim 1 wherein the at least one flap is having a semi circular shape, or an arch rounded shape, or an angled arch shape.

6. The device of claim 1 wherein said at least one device forms an open loop about said limb.

7. The device of claim 1 wherein the at least one flap is fabricated from a light metal, or light metal alloy, or a rigid or a semi-rigid polymeric material, or a combination thereof.

8. The device of claim 1 wherein the at least one flap comprises an at least one movable segment.

9. The device of claim 1 wherein the at least one flap comprises at least two segments positioned so as to form an angle with each other.

10. The device of claim 1 wherein the device further comprises an at least one second flap and wherein the actuator is coupled to both said at least one and said at least second flaps and is configured to move said at least one and said at least second flaps inwardly and outwardly such as to apply compression force to the limb.

11. The device of claim 1 wherein said mechanism is a mechanical mechanism.

12. The device of claim 1 wherein said mechanism is a pneumatic or a hydraulic mechanism.

13. The device of claim 1 wherein the actuator is adapted to be mounted on the limb.

14. The device of claim 1 wherein during operation at least one component of the actuator is adapted not to be mounted on the limb.

15. The device according to claim 1 wherein the abrupt transition is in the range of about 30 msec to about 10 sec.

16. The device of claim 1 wherein the mechanism comprises at least two levers invertly connected through at least one pivot to said at least one flap for applying compression on said limb.

17. The device of claim 16 further wherein said at least one spring is a return spring configured for forcing the at least two levers to move inwardly.

18. The device of claim 17 wherein said return spring is juxtaposed between bottom sides of the at least two levers and above the at least one pivot to avoid contact with the limb.

19. The device of claim 1 wherein the device includes an inflatable cell.

20. The device of claim 1 further comprising a regulator for regulating the frequency of said periodical movement.

21. The device of claim 20 wherein said frequency is a variable frequency.

22. The device of claim 1 wherein said periodical movement is an intermittent movement or a continuous movement.

23. The device of claim 1 wherein a cycle of the periodical movement of the at least one flap comprises one or more relaxed states of the flap and or more contracted state of the flap.

24. The device of claim 23 wherein the periodical movement of the at least one flap comprises a fast transition of about 30 msec to about 10 sec from a contracted to relaxed state or from relaxed to contracted state.

25. The device of claim 23 wherein the cycle is asymmetric.

26. The device of claim 1 wherein said at least one abrupt transition is from the relaxed state to the compressed state of the limb.

27. The device of claim 1 wherein said at least one abrupt transition is from the compressed state to the relaxed state of the limb.

28. A method for modulating blood or lymph flow in a limb, the method comprising the steps of:

partially encircling the limb with at least one flap;

providing a controlled movement to said at least one flap to cause a periodical change of the position of said at least one flap relative to the limb for applying intermittent squeezing forces on the limb, wherein said periodical change comprises at least one abrupt transition between relaxed and contracted states of the flap, said abrupt transition is effectuated by releasing energy stored in a spring coupled to said flap.

29. The method of claim 28 wherein the at least one flap is rigid.

30. The method of claim 28 wherein the at least one flap is having a semi circular shape, or an arch rounded shape, or an angled arch shape.

31. The method of claim 28 wherein the at least one flap is fabricated from a light metal, or light metal alloy, or a rigid or a semi-rigid polymeric material, or a combination thereof.

32. The method of claim 28 wherein the at least one flap comprises an at least one movable segment.

33. The method of claim 28 wherein the at least one flap comprises two movable flaps configured to be placed on opposite sides of the limb and wherein the flaps are periodically moved toward and away from each other.

34. The method of claim 28 further comprising regulating the frequency of periodical change.

35. The method of claim 34 wherein the periodical change comprises one or more contracted states and one or more relaxed states.

36. The method of claim 28 for use of treating any one of the following: a vascular disorder; a deep vein thrombosis; lymphedema, chronic wounds, venous insufficiency, peripheral arterial disease.

37. The method of claim 28 for use to improve circulation of blood or lymph flow.

38. The method of claim 28 wherein said at least one abrupt transition is from the relaxed state to the contracted state of the flap.

39. The method of claim 28 wherein said at least one abrupt transition is from the contracted state to the relaxed state of the flap.

* * * * *